US009730517B2

(12) United States Patent
Youngs et al.

(10) Patent No.: US 9,730,517 B2
(45) Date of Patent: Aug. 15, 2017

(54) STORAGE ASSEMBLY WITH PULL-OUT ARRANGEMENT

(71) Applicant: Steelcase Inc., Grand Rapids, MI (US)

(72) Inventors: Bradley Youngs, Byron Center, MI (US); Alvin Larson, Jenison, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 15/150,878

(22) Filed: May 10, 2016

(65) Prior Publication Data

US 2016/0345731 A1 Dec. 1, 2016

Related U.S. Application Data

(60) Provisional application No. 62/166,818, filed on May 27, 2015.

(51) Int. Cl.

| | |
|---|---|
| ***A47B 97/00*** | (2006.01) |
| ***A47B 96/04*** | (2006.01) |
| ***A47B 88/41*** | (2017.01) |
| ***A47B 88/487*** | (2017.01) |
| ***A47B 46/00*** | (2006.01) |
| ***A47B 83/00*** | (2006.01) |
| ***A47B 88/42*** | (2017.01) |

(52) U.S. Cl.

CPC ..... *A47B 96/04* (2013.01); *A47B 46/00* (2013.01); *A47B 83/001* (2013.01); *A47B 88/41* (2017.01); *A47B 88/42* (2017.01); *A47B 88/487* (2017.01); *A47B 2210/0056* (2013.01); *A47B 2220/0077* (2013.01)

(58) Field of Classification Search

CPC ..... A47B 96/04; A47B 46/00; A47B 83/001; A47B 2210/0056; A47B 2220/0077

USPC ..... 312/317.1, 249.9

See application file for complete search history.

(56) References Cited

U.S. PATENT DOCUMENTS

| | | | | |
|---|---|---|---|---|
| 441,433 A | | 11/1890 | Mead | |
| 535,033 A | | 3/1895 | Velen | |
| 1,281,923 A | * | 10/1918 | Fales | A47B 88/0485 312/317.2 |
| 1,377,626 A | | 5/1921 | Phillips | |
| 2,002,455 A | | 5/1935 | Schwerin | |
| 2,066,608 A | * | 1/1937 | Bushnell | A47B 17/033 312/204 |
| 2,327,761 A | * | 8/1943 | Brodbeck | F24C 15/18 126/37 R |
| 2,425,675 A | | 8/1947 | Graff | |
| 2,742,675 A | | 4/1956 | Robertson | |
| 2,800,679 A | | 7/1957 | Schultz, Jr. | |

(Continued)

*Primary Examiner* — Hanh V Tran

(74) *Attorney, Agent, or Firm* — Price Heneveld LLP

(57) ABSTRACT

A storage assembly includes a storage cabinet having an interior space and a slide-out storage assembly operable between open and closed positions relative to the storage cabinet. The slide-out storage assembly includes a base assembly having one or more integrally formed mounting brackets formed thereon. One or more caster assemblies are mounted to the one or more integrally formed mounting brackets of the base assembly of the slide-out storage assembly. The one or more caster assemblies are vertically adjustable along the one or more integrally formed mounting brackets of the base assembly. The slide-out storage assembly further includes a faceplate coupled to the base assembly and adjustably associated with the storage cabinet.

18 Claims, 21 Drawing Sheets

(56) References Cited

U.S. PATENT DOCUMENTS

| | | | | |
|---|---|---|---|---|
| 3,027,680 | A | 4/1962 | Gallagher, Jr. | |
| 3,437,346 | A | 4/1969 | Cobb | |
| 3,844,578 | A | 10/1974 | Matyskella et al. | |
| 3,858,270 | A | 1/1975 | Crowe | |
| 3,959,849 | A | 6/1976 | Marquardt | |
| 3,989,128 | A | 11/1976 | Walker | |
| 4,026,570 | A | 5/1977 | Feinberg | |
| 4,090,753 | A | 5/1978 | Rock et al. | |
| 4,124,187 | A | 11/1978 | Webb | |
| 4,173,380 | A | 11/1979 | Dupree | |
| 4,337,988 | A | 7/1982 | Schenck | |
| 4,369,763 | A | 1/1983 | Sullivan | |
| 4,589,710 | A | 5/1986 | Rock et al. | |
| 4,590,709 | A | 5/1986 | Katsman et al. | |
| 4,595,245 | A | 6/1986 | Rock et al. | |
| 4,596,232 | A | 6/1986 | Dowding | |
| 4,741,583 | A | 5/1988 | Rock et al. | |
| 4,763,868 | A | 8/1988 | Teich | |
| 4,789,121 | A | 12/1988 | Gidseg et al. | |
| 4,817,237 | A | 4/1989 | Murphy | |
| 4,861,122 | A | 8/1989 | Newhouse et al. | |
| 4,874,209 | A | 10/1989 | Spitzer et al. | |
| 4,961,614 | A | 10/1990 | Rock | |
| 5,222,791 | A | 6/1993 | Held et al. | |
| 5,426,817 | A | 6/1995 | Rekuc | |
| 5,460,443 | A | 10/1995 | Ferrari et al. | |
| 5,549,378 | A | 8/1996 | Grabher | |
| 5,558,027 | A | 9/1996 | Williams et al. | |
| 5,607,214 | A | 3/1997 | Pierce et al. | |
| 5,737,801 | A | 4/1998 | Flood | |
| 5,743,603 | A | 4/1998 | Kelley et al. | |
| 5,924,779 | A * | 7/1999 | Krumholz | A47B 88/0485 211/151 |
| 5,944,291 | A | 8/1999 | Kato et al. | |
| 5,971,408 | A | 10/1999 | Mandel et al. | |
| 6,053,588 | A | 4/2000 | Biggel et al. | |
| 6,279,199 | B1 | 8/2001 | Plate | |
| 6,398,323 | B1 * | 6/2002 | Lee | A47B 46/00 312/205 |
| 6,408,482 | B1 | 6/2002 | Henriott et al. | |
| 6,824,231 | B2 | 11/2004 | Jakob-Bamberg et al. | |
| 6,826,800 | B2 | 12/2004 | Kao | |
| 6,839,937 | B2 | 1/2005 | Miller | |
| 6,865,774 | B2 | 3/2005 | Devine et al. | |
| 6,948,788 | B1 * | 9/2005 | Tai | A47B 88/0055 312/204 |
| 7,281,774 | B2 | 10/2007 | Zenda et al. | |
| 7,350,269 | B2 | 4/2008 | Dominic et al. | |
| 7,355,131 | B2 | 4/2008 | Pathmanathan et al. | |
| 7,481,405 | B2 | 1/2009 | Johnson | |
| 7,484,726 | B2 | 2/2009 | Hashimoto et al. | |
| 7,571,959 | B2 | 8/2009 | Griepentrog | |
| 7,600,294 | B2 | 10/2009 | Hartman | |
| 8,038,234 | B2 | 10/2011 | Weber | |
| 8,047,621 | B2 | 11/2011 | Walburn | |
| 8,141,885 | B2 | 3/2012 | Fan et al. | |
| 8,240,681 | B2 | 8/2012 | Taguchi | |
| 8,388,076 | B2 | 3/2013 | Walburn | |
| 8,485,614 | B2 | 7/2013 | Golias, Jr. et al. | |
| 8,585,165 | B2 | 11/2013 | Liang et al. | |
| 8,752,915 | B2 | 6/2014 | Alves | |
| 8,939,526 | B1 * | 1/2015 | Chambers | A47B 77/18 312/348.4 |
| 9,039,109 | B2 | 5/2015 | Salice | |
| 2003/0061681 | A1 | 4/2003 | Plate | |
| 2005/0015928 | A1 | 1/2005 | Arsenault et al. | |
| 2011/0163647 | A1 | 7/2011 | Hartl | |
| 2012/0286116 | A1 | 11/2012 | Gasser | |
| 2013/0180168 | A1 | 7/2013 | Elliott | |
| 2014/0015391 | A1 | 1/2014 | Feuerstein | |

* cited by examiner

STORAGE ASSEMBLY WITH PULL-OUT ARRANGEMENT

CROSS REFERENCE TO RELATED APPLICATION

This present application claims the benefit of U.S. Provisional Application No. 62/166,818 entitled "STORAGE ASSEMBLY WITH PULL-OUT ARRANGEMENT" filed on May 27, 2015, the entire contents of which are incorporated by reference.

BACKGROUND OF THE INVENTION

The present disclosure relates to a storage assembly, and in particular, to a storage cabinet having a slide-out storage feature.

BRIEF SUMMARY OF THE INVENTION

The following presents a simplified summary of the disclosed storage assembly to provide a basic understanding of some aspects of the invention. This summary is not an extensive overview of the invention. It is intended to neither identify key or critical elements of the storage assembly nor delineate the scope of the invention. Its sole purpose is to present some concepts of the storage assembly in a simplified form as a prelude to the more detailed description that is presented later.

One aspect of the disclosed storage assembly is to provide a first storage assembly having a housing, wherein the housing defines an interior space. A second storage assembly is operable between stowed and extended positions relative to the interior space of the first storage assembly. The second storage assembly includes a base assembly with an adjustable faceplate coupled thereto. The faceplate closes off an opening to the interior space of the first storage assembly when the second storage assembly is in the stowed position.

Another embodiment provides a storage assembly having a storage cabinet with an interior space, and a slide-out storage assembly operable between stowed and extended positions relative to the interior space of the storage cabinet. The slide-out storage assembly includes a base assembly having one or more adjustable caster assemblies coupled thereto to support the base assembly in a rolling manner. The one or more adjustable caster assemblies are individually adjustable and are configured to support the base assembly from a floor surface.

Yet another embodiment provides a storage assembly having a storage cabinet with an interior space. A slide-out storage assembly is operable between stowed and extended positions relative to the storage cabinet and includes a base assembly having one or more integrally formed mounting brackets formed thereon. One or more caster assemblies are mounted on the one or more integrally formed mounting brackets of the base assembly of the slide-out storage assembly. The one or more caster assemblies are vertically adjustable along the one or more integrally formed mounting brackets of the base assembly.

These and other features, advantages, and objects of the present invention will be further understood and appreciated by those skilled in the art by reference to the following specification, claims, and appended drawings.

DETAILED DESCRIPTION

Figure 1:
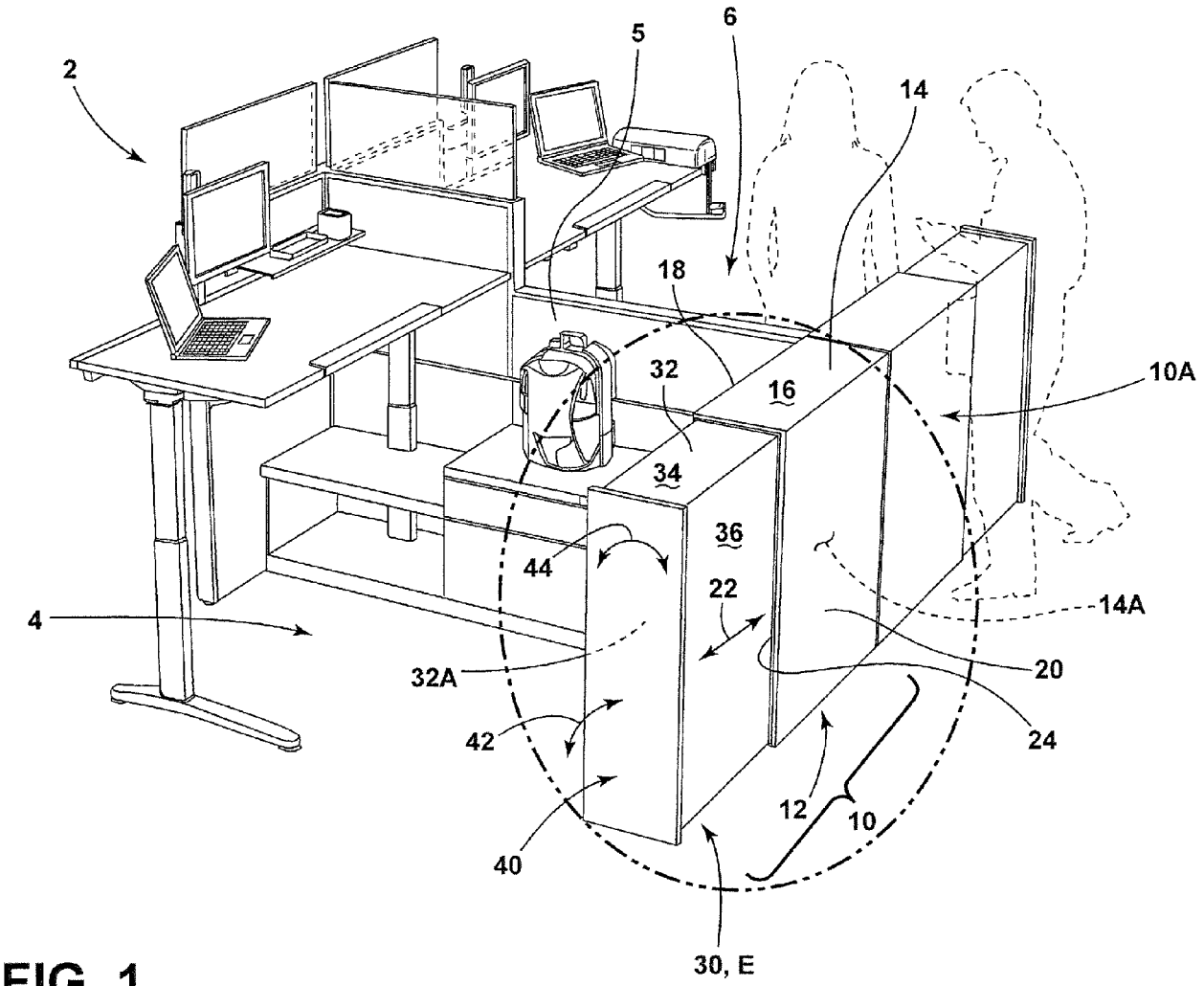
FIG. 1 is a perspective view of an office environment having a storage assembly.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3A:
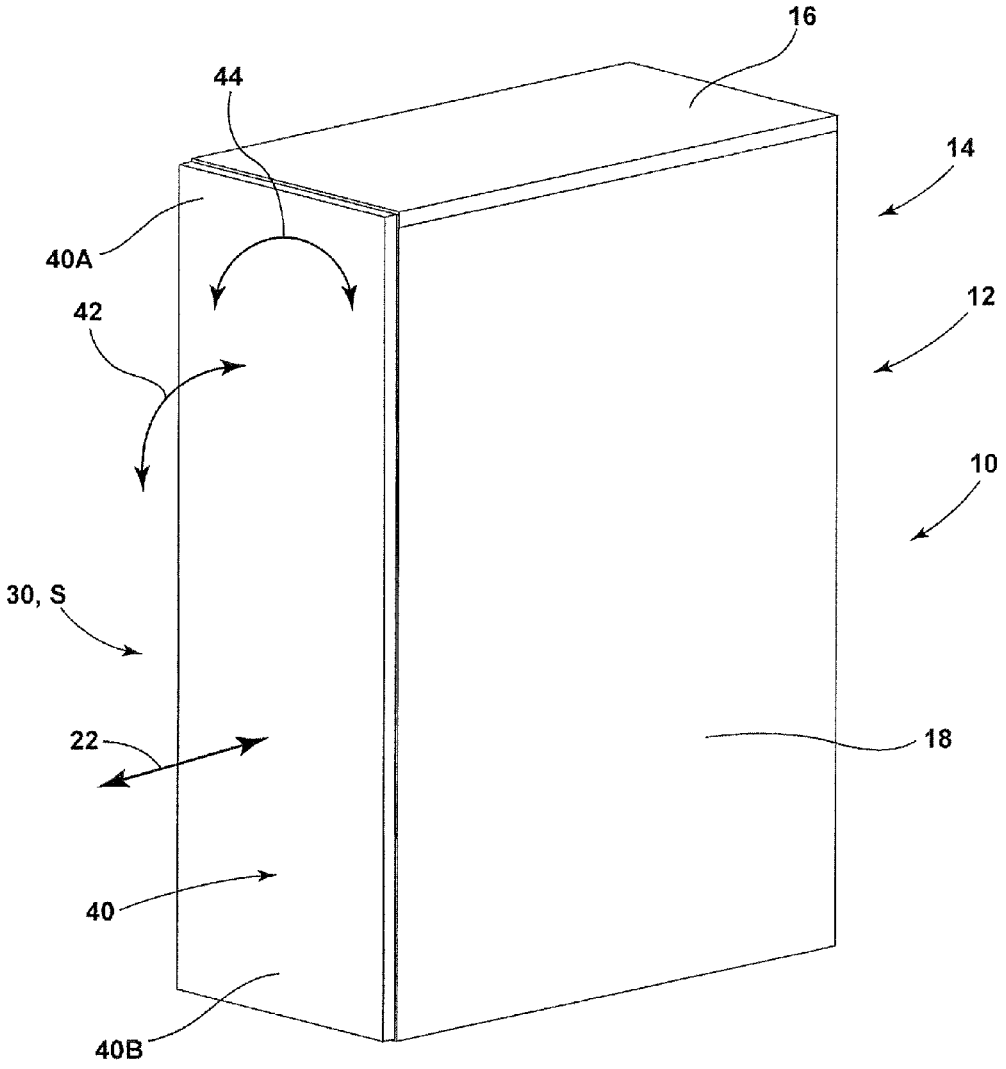
FIG. 3A is a front perspective view of a storage assembly, wherein a slide-out storage assembly is in a stowed position relative to a storage cabinet.

Referring now to FIG. 1, the reference numeral 10 generally designates a storage assembly. The storage assembly 10 may be provided in an office environment 2 having workstations 4, 6, wherein the storage assembly 10 may generally define an end portion of workstation 4. In FIG. 1, the workstations 4, 6 are separated by a panel system 5. It is contemplated that the panel system 5 can be anchored to, or otherwise coupled to and supported by, one or more storage assemblies, such as storage assembly 10. The Reference numeral 10A designates a second storage assembly, which may define an end portion of workstation 6 and may also serve as a support structure for the panel system 5. It is contemplated that the storage assemblies 10, 10A are substantially similar and include similar components throughout. The storage assembly 10 generally includes a first storage assembly 12 which generally defines a storage cabinet. The storage cabinet 12 includes a housing 14 which generally comprises a top wall 16 coupled to opposing sidewalls 18, 20 to define an interior space or interior volume 14A. The interior space 14A of the storage cabinet 12 may be used to house a slide-out storage assembly indicated in FIG. 1 as reference numeral 30. The slide-out storage assembly 30 defines a second storage assembly relative to the first storage assembly defined by the storage cabinet 12. The slide-out storage assembly 30 may be operable between extended and stowed positions relative to the storage cabinet 12, and is shown in FIG. 1 in the extended position E. The slide-out storage assembly 30 may be configured to move laterally outward from the interior space 14A of the storage cabinet 12 between the extended and stowed positions in a path as indicated by arrow 22. The slide-out storage assembly 30 includes a housing 32 having a top wall 34 and a sidewall 36. The slide-out storage assembly 30 may further include a faceplate 40, which, together with the top wall 34 and sidewall 36 defines a storage space 32A. The faceplate 40 is configured to close off an opening 24 to the storage cabinet 12 when the slide-out storage assembly 30 is in the stowed position S (FIG. 3A). Further, the faceplate 40 may be adjustable in a fore and aft direction, as indicated by arrow 42, and a tilt direction as indicated by arrow 44. In this way, the faceplate 40 can accommodate for uneven floor surfaces on which the storage assembly 10 may be supported. Further, the adjustability of the faceplate 40 contributes to a proper fitting of the faceplate 40 in the opening 24 of the storage cabinet 12, when the slide-out storage assembly 30 is in the stowed position S.

Figure 2:
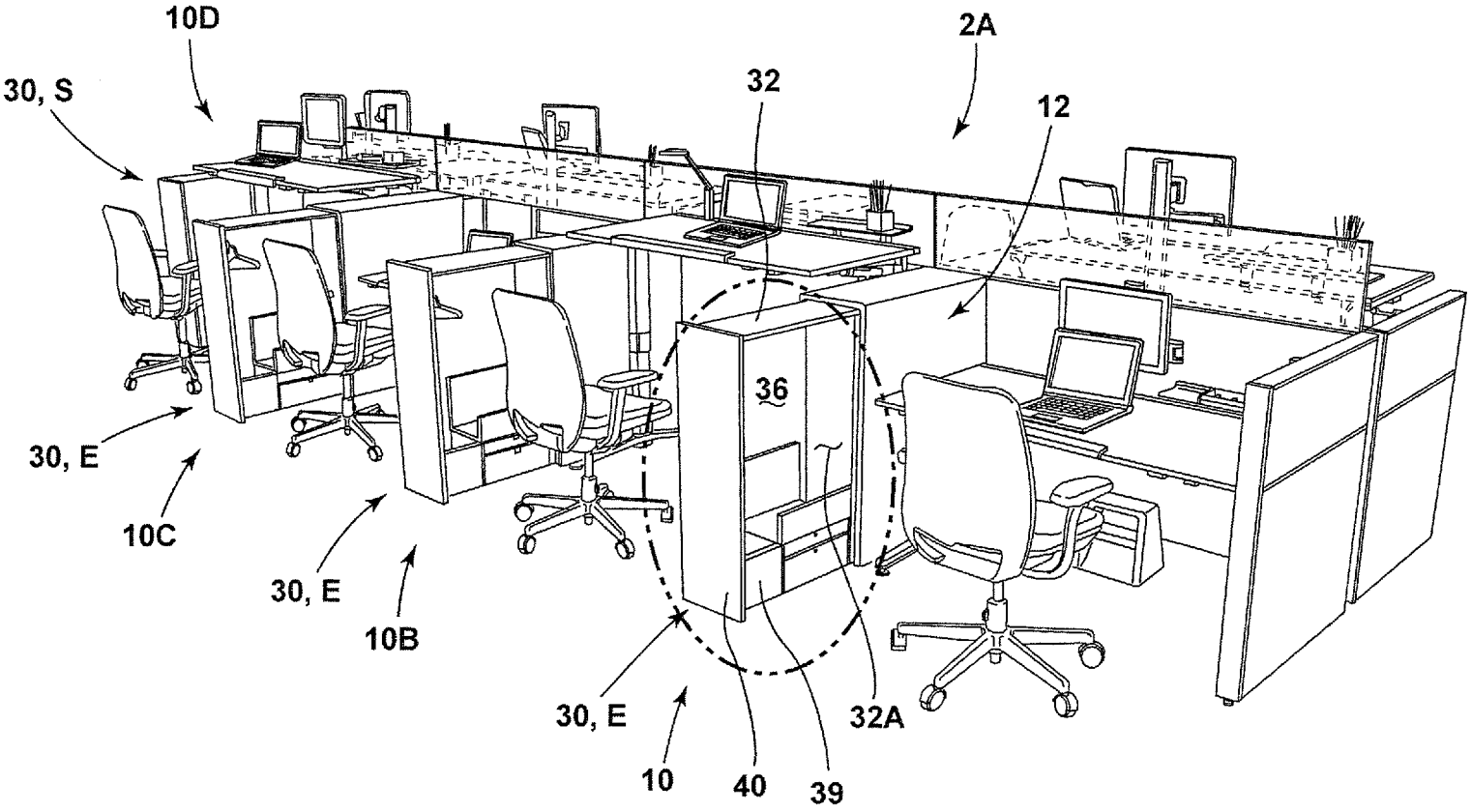
FIG. 2 is a perspective view of another office environment having a number of storage assemblies.

Referring now to FIG. 2, another office environment 2A is shown having a furniture configuration, wherein a number of workstations are separated by storage assemblies 10, 10B-10D. Storage assemblies 10, 10B and 10C are shown having the slide-out storage assembly 30 in the extended position E. Storage assembly 10D is shown having the slide-out storage assembly 30 in the stowed position S, wherein the slide-out storage assembly 30 is generally received in storage cabinet 12. The storage space 32A is shown to include a number of accessories 39, which are contemplated to include shelves, drawers, dividing walls, as well as hooks for hanging garments, such that the storage space 32A essentially provides a locker environment for an office occupant, which can be easily accessed or stowed to conceal the contents of a storage space 32A.

Thus, as shown in FIGS. 1 and 2, the storage assembly 10 may provide a boundary element for a workstation and also provide user control of privacy in a compact benching application. The storage assembly 10 is contemplated to provide a standing height furniture component which may be approximately 42-48 inches high to support collaboration among office users, as specifically shown in FIG. 1.

Figure 3B:
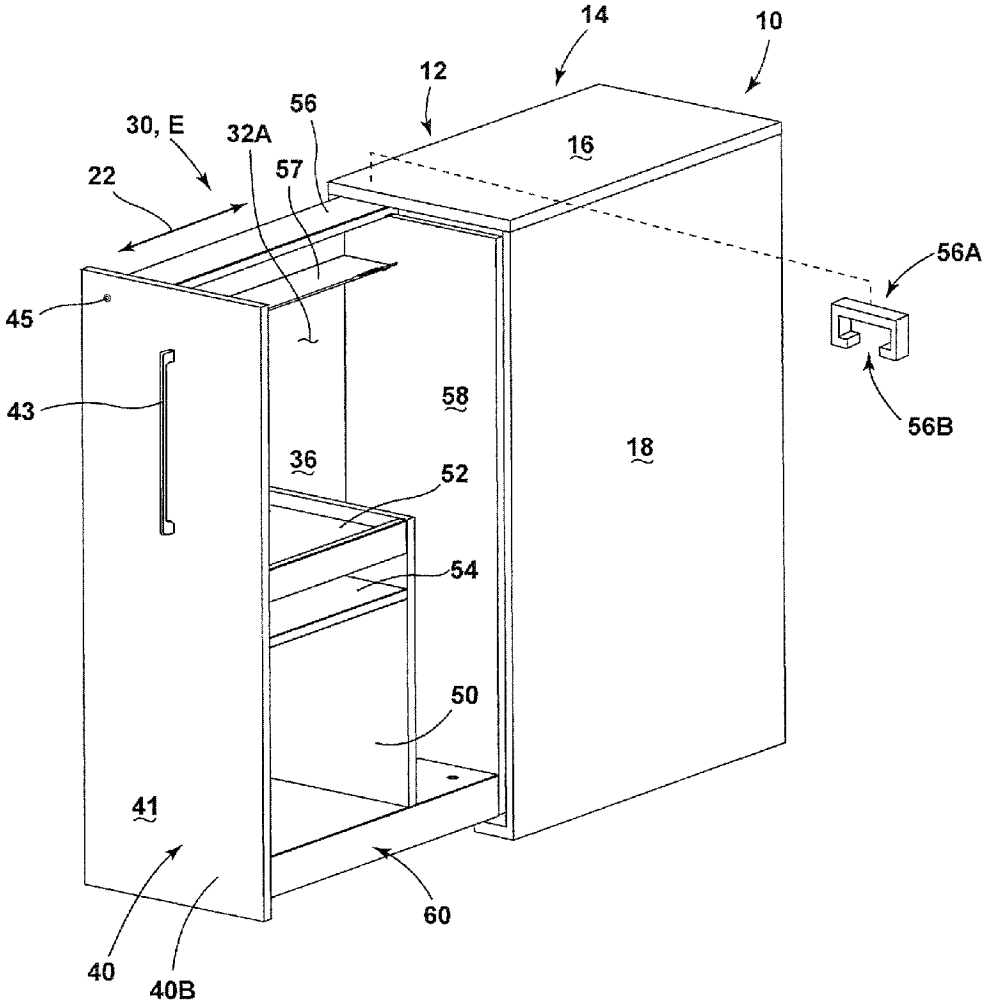
FIG. 3B is a front perspective view of the storage assembly of FIG. 3A, wherein the slide-out storage assembly is in an extended position relative to the storage cabinet.

Referring now to FIG. 3A, the storage assembly 10 is shown with the slide-out storage assembly 30 in the stowed position S. Arrow 42 indicates a fore and aft adjustment of an upper portion 40A of faceplate 40, while arrow 44 represents a right to left tilt adjustment of the faceplate 40. Adjustment of the faceplate 40 may be realized using various adjustment mechanisms disposed in a base assembly 60 (FIG. 3B) coupled to the faceplate 40 at a lower portion 40B thereof, as further described below. With reference to FIG. 3B, the storage assembly 10 is shown with the slide-out storage assembly 30 in the extended position E, which may also be referred to as the deployed position. In the embodiment shown in FIG. 3B, the faceplate 40 includes a lock mechanism 45 for locking the slide-out storage assembly 30 to the storage cabinet 12 in the stowed position S (FIG. 3A), and further includes a handle 43 for a user to grasp and pull the slide-out storage assembly 30 to the extended position E. In the extended or deployed position E, the storage space 32A of the slide-out storage assembly 30 is accessible for use by an office occupant. In the embodiment shown in FIG. 3B, the storage space 32A includes a dividing wall 50 which is spaced-apart from the faceplate 40 with first and second shelves 52, 54 coupled therebetween. The dividing wall 50, as well as the first and second shelves 52, 54, may also be coupled to sidewall 36 of the slide-out storage assembly 30. As noted above, the lower portion 40B of the faceplate 40 is coupled to the base assembly 60 which moves laterally from the storage cabinet 12 as part of the slide-out storage assembly 30, and further supports the various components of the slide-out storage assembly 30. The base assembly 60 may include adjustment mechanisms for adjusting a position of the faceplate 40, as further described below, to plumb the faceplate 40 relative to the storage cabinet 12. As further shown in FIG. 3B, an upper guide member 56 is shown and may be used to guide the movement of the slide-out storage assembly 30 between extended and stowed positions E, S in use. Specifically, the guide member 56 is slidingly received in a guide bracket 56A which is mounted to an interior surface of the top wall 16 of the storage cabinet 12. In FIG. 3B, the guide bracket 56A is shown exploded away from the storage cabinet 12 to reveal a downwardly opening channel 56B in which the guide member 56 is slidingly received for guiding linear movement of the slide-out storage assembly 30 between extended and stowed positions E, S, relative to the storage cabinet 12.

Figure 3C:
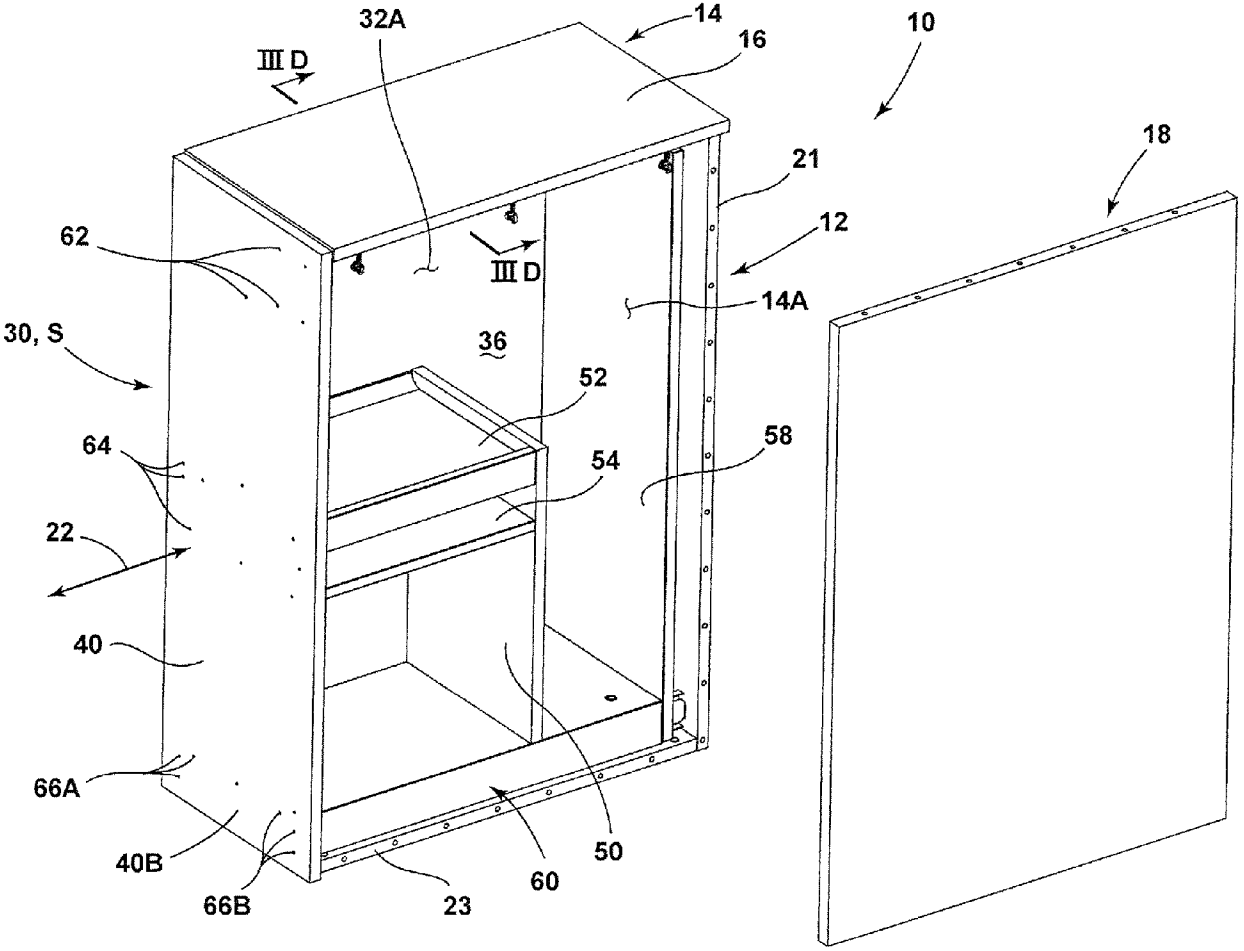
FIG. 3C is a front perspective view of the storage assembly of FIG. 3A, having a side wall exploded away from the storage cabinet.

Referring now to FIG. 3C, sidewall 18 of storage cabinet 12 is shown removed from the storage assembly 10 to reveal the interior volume 14A of the storage cabinet 12, in which the slide-out storage assembly 30 is disposed in the stowed position S. The storage cabinet 12 includes a rear wall 21 and a bottom wall 23, which, along with top wall 16 couple to sidewall 18, 20 (FIG. 3D) to define the interior volume 14A of the housing 14 of the storage cabinet 12. The slide-out storage assembly 30 may also include a rear wall 58 which is coupled to the base assembly 60 for lateral movement along the path as indicated by arrow 22 between extended and stowed positions E, S, of the slide-out storage assembly 30. The rear wall 58 is shown disposed opposite the faceplate 40 to further define the storage space 32A. As further shown in FIG. 3C, the faceplate 40 may include a number of mounting apertures such as upper mounting apertures 62, intermediate mounting apertures 64 and lower mounting apertures 66A and 66B. The upper mounting apertures 62 may be used to couple the faceplate 40 to the upper guide member 56 (FIG. 3B) while the intermediate mounting aperture 64 may be used to couple the first and second shelves 52, 54 to the faceplate 40 or to mount the handle 43 (FIG. 3B) on the faceplate 40. It will be understood that any configuration of shelves and dividing walls may be disposed within the storage space 32A of the slide-out storage assembly 30 and is not necessarily limited to the configuration of the first and second shelves 52, 54 and the dividing wall 50 shown in FIGS. 3B and 3C. The lower mounting apertures 66A, 66B may be used to couple the lower portion 40B of the faceplate 40 to the base assembly 60, such that adjustment of a position of the base assembly 60 will correspondingly adjust a related position of the faceplate 40, as further described below. It is contemplated that an outer skin 41 (FIG. 3B) can be coupled to an outer surface of the faceplate 40 to provide a uniform aesthetic for the faceplate 40.

Figure 3D:
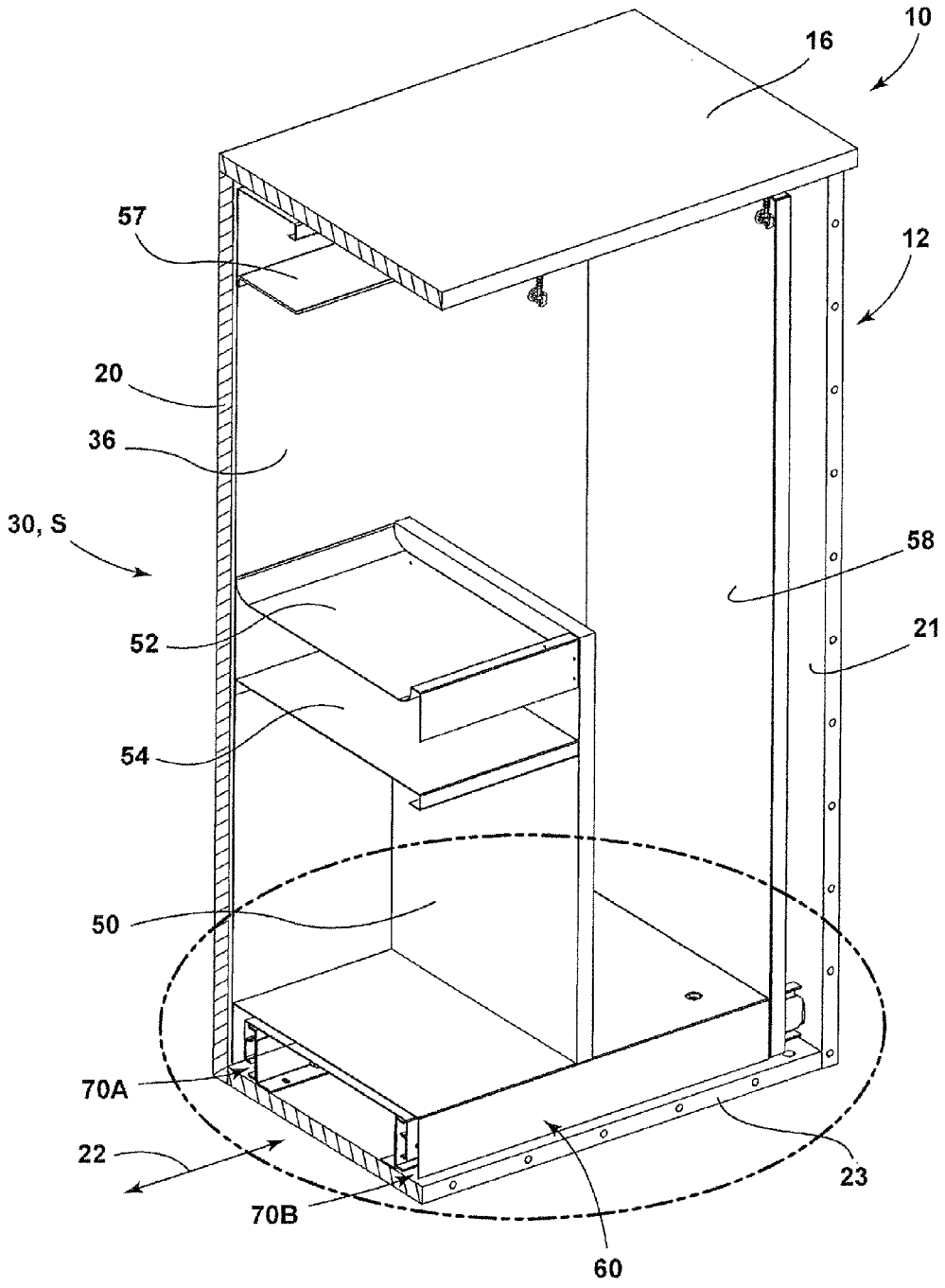
FIG. 3D is a cross-sectional view of the storage assembly of FIG. 3C taken at line IIID.

Referring now to FIG. 3D, a cross-sectional view of the storage assembly 10 is shown, wherein the base assembly 60 of the slide-out storage assembly 30 is slideably coupled to the bottom wall 23 of the storage cabinet 12. The base assembly 60 may be slideably coupled to the bottom wall 23 of the storage cabinet 12 via first and second slide assemblies 70A, 70B as further described below with reference to FIG. 3E.

Figure 3E:
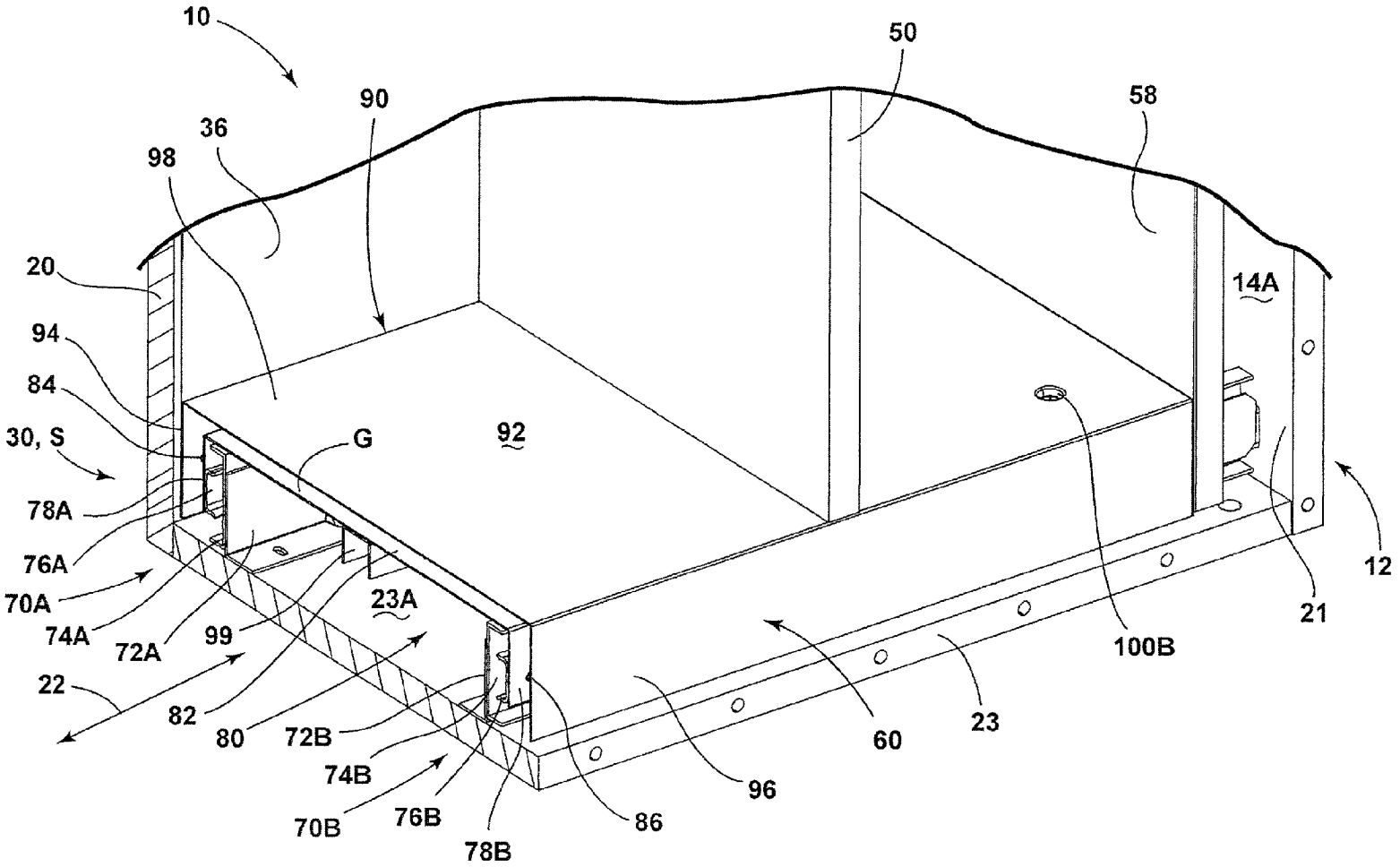
FIG. 3E is an enlarged view of the storage assembly of FIG. 3D taken at location IIIE.

Referring now to FIG. 3E, the base assembly 60 is shown as disposed within the interior volume 14A of the storage cabinet 12 while the slide-out storage assembly 30 is in the stowed position S. The base assembly 60 may include a chassis member 80 which is defined by a top wall 82 having downwardly extending sidewalls 84, 86 such that the chassis member 80 has a generally inverted U-shaped configuration. The chassis member 80 may be slideably coupled to the storage cabinet 12 via the first and second slide assemblies 70A, 70B which may be further coupled to the bottom wall 23 of the storage cabinet 12. The base assembly 60 may further include an outer shell 90 having a top wall 92 and downwardly extending sidewalls 94, 96, such that the outer shell 90 has an inverted U-shaped configuration similar to, but larger than, the chassis member 80 to cover the chassis member 80. The top wall 92 of the outer shell 90 may define a platform 98 which supports the dividing wall 50 and may be available to the office occupant for the storage of items, such that the platform 98 serves as a floor to the storage space 32A of the slide-out storage assembly 30. The outer shell 90 may be coupled to the chassis member 80, yet spaced apart from the chassis member 80 at a gap G disposed between the outer shell 90 and the chassis member 80 along the respective walls thereof. As further described below, the gap G between the outer shell 90 and the chassis member 80 can be adjusted, which in turn, adjusts a position of the faceplate 40 described above. The gap G between the outer shell 90 and the chassis member 80 is adjusted due to pivoting, or otherwise adjustable, connection between the outer shell 90 and the chassis member 80, as further described below.

As further shown in FIG. 3E, the bottom wall 23 of the storage cabinet 12 may include L-shaped brackets 72A, 72B which may be coupled to an upper surface 23A of the bottom wall 23. The L-shaped brackets 72A, 72B extend upwardly from the upper surface 23A of bottom wall 23. On outside portions of the L-shaped brackets 72A, 72B, first slide members 74A, 74B of the first and second slide assemblies 70A, 70B may be coupled thereto. The first slide members 74A, 74B may be stationary members as coupled to the L-shaped brackets 72A, 72B which are further coupled to the bottom wall 23 of the cabinet 12. A second slide member 76A may be coupled to the first slide member 74A in a sliding relationship similar to a drawer slide as known in the art. Further, a second slide member 76B may be coupled to the first slide member 74B of the slide assembly 70B in a similar manner. The second slide member 76A may be further coupled to the downwardly extending sidewall 84 of the chassis member 80 at one of several coupling locations 78A. Similarly, the second slide member 76B may be further coupled to the downwardly extending sidewall 86 of the chassis member 80 at one of several coupling locations 78B. As coupled to respective first slide members 74A, 74B, the second slide members 76A, 76B may be configured to move outwardly from the interior volume 14A of the storage cabinet 12, such that the chassis member 80 and outer shell 90 of the base assembly 60 move therewith along a path as indicated by arrow 22. This movement along the path as indicated by arrow 22 moves the slide-out storage assembly 30 between the stowed and extended positions S, E. It is further contemplated that first and second drawer slide assemblies 70A, 70B may be 3-part slide assemblies for added support. A lower guide member 99 may be disposed on an underside of the top wall 82 of the chassis member 80 to guide the lateral movement of the slide-out storage assembly 30 relative to the storage cabinet 12. As further shown in FIG. 3E, an example of a pivoting coupling location between the outer shell 90 and chassis member 80 is shown at location 100B.

Figure 3F:
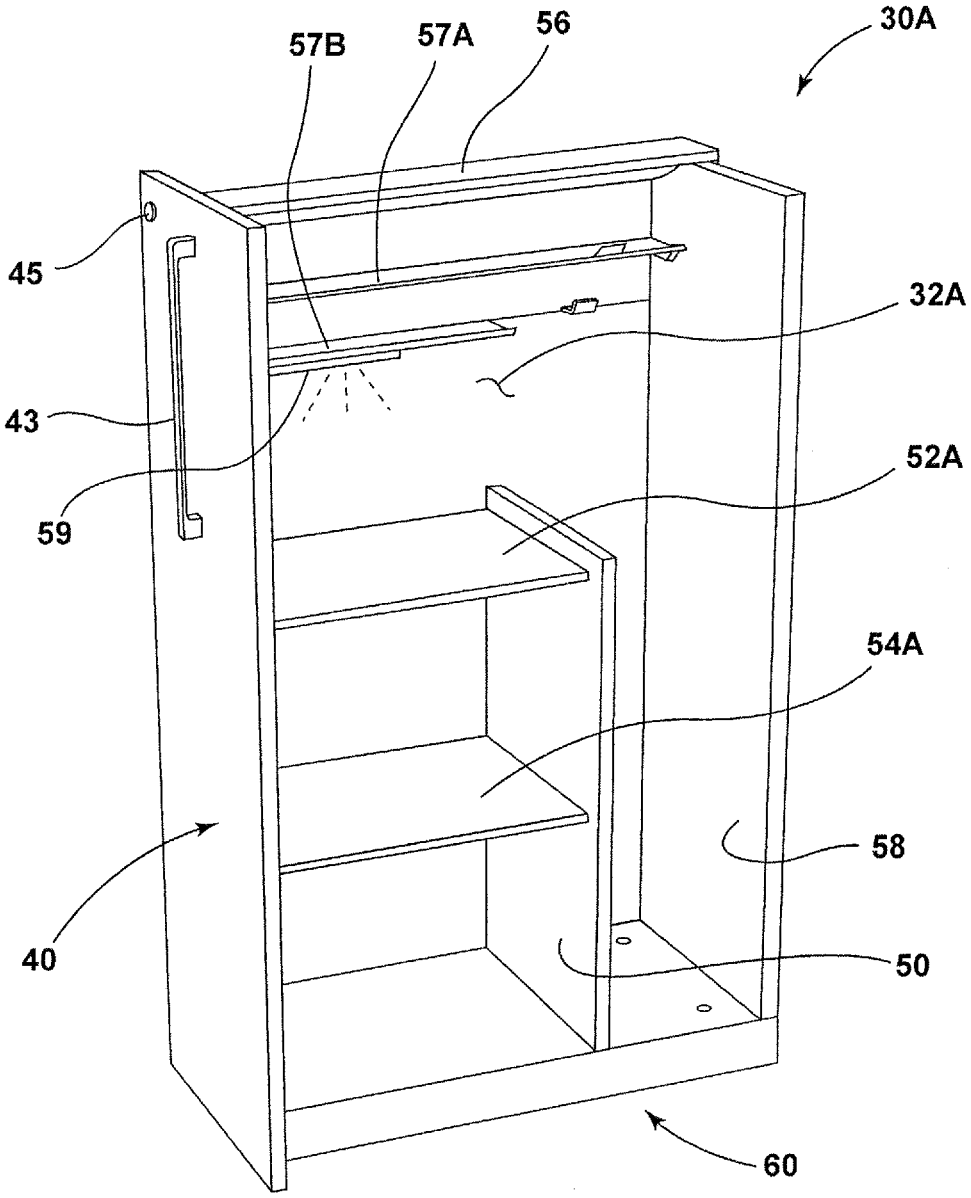
FIG. 3F is a front perspective view of a slide-out storage assembly of another embodiment as removed from a storage cabinet.

Referring now to FIG. 3F, another embodiment of a slide-out storage assembly 30A is shown as removed from a corresponding storage cabinet. The slide-out storage assembly 30A may include a reconfigured storage space 32A as compared to the storage space 32A of slide-out storage assembly 30 shown in FIG. 3B. In FIG. 3F, the slide-out storage assembly 30A includes first and second upper shelves 57A, 57B along with a light assembly 59 disposed below second upper shelf 57B. It is contemplated that the light assembly 59 may be configured to illuminate the storage space 32A when the slide-out storage assembly 30A is in the extended position relative to a storage cabinet, such as storage cabinet 12 shown in FIG. 3B. The light assembly 59 may be configured to turn off when the slide-out storage assembly 30A is in a stowed position relative to a storage cabinet, such as in the configuration shown in FIG. 3A. As further shown in FIG. 3F, the slide-out storage assembly 30A further includes first and second shelves 52A, 54A which are spaced-apart from one another and interconnected between face plate 40 and dividing wall 50.

Figure 4A:
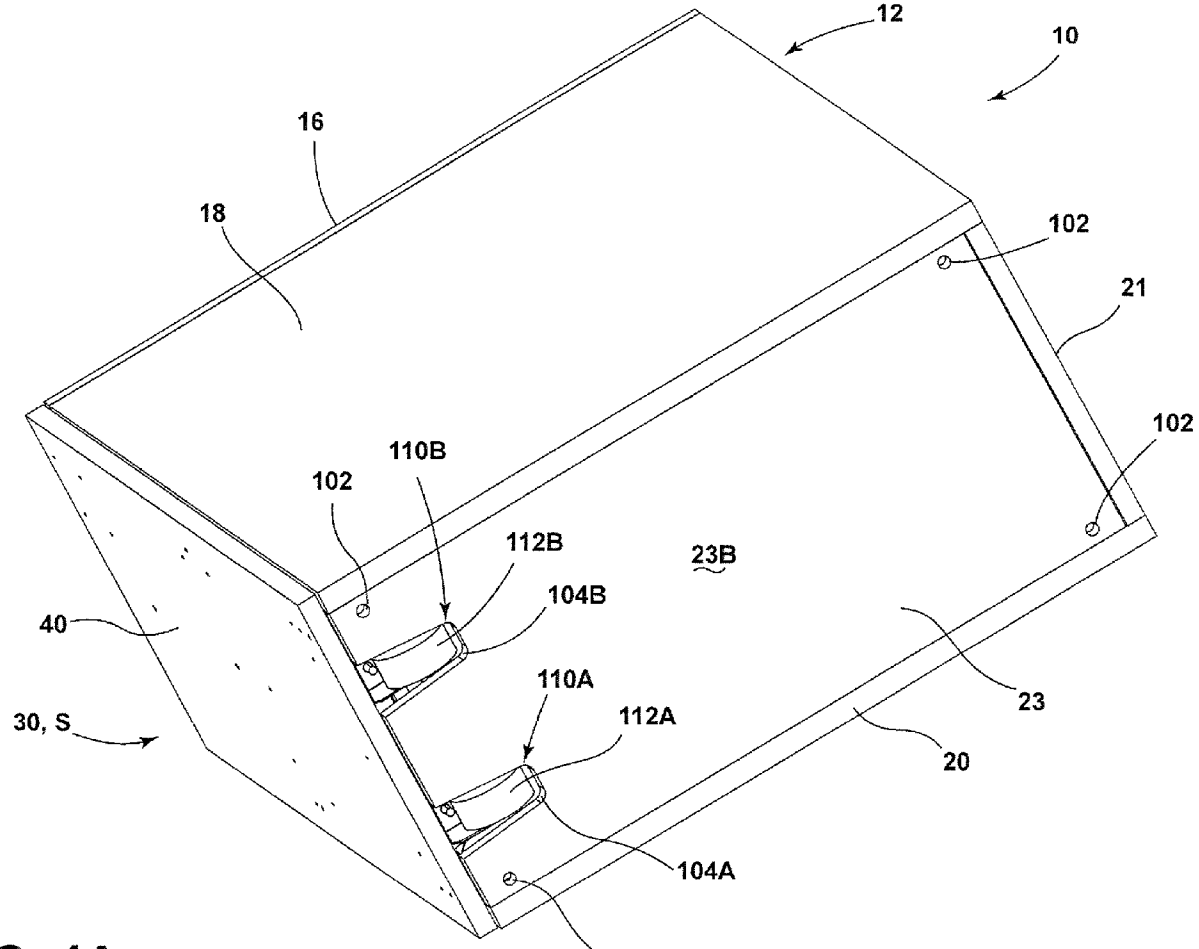
FIG. 4A is a bottom perspective view of the storage assembly of FIG. 3A.

Referring now to FIG. 4A, the storage assembly 10 is shown from a bottom perspective view, wherein the bottom wall 23 is shown as having mounting apertures 102 disposed at the outer corners thereof. Mounting apertures 102 are contemplated to receive adjustable feet or stand-off members for supporting the storage cabinet 12 from a floor surface. The bottom wall 23 may further include relief portions 104A, 104B which are disposed through the upper and lower surfaces 23A, 23B of the bottom wall 23. The relief portions 104A, 104B may be disposed adjacent to the faceplate 40 when the slide-out storage assembly 30 is in the stowed position S, as shown in FIG. 4A. The relief portions 104A, 104B may be configured to receive rolling members 110A, 110B which are configured to support the slide-out storage assembly 30 from a floor surface as the slide-out storage assembly 30 moves between the stowed position S and the extended position E.

Figure 4B:
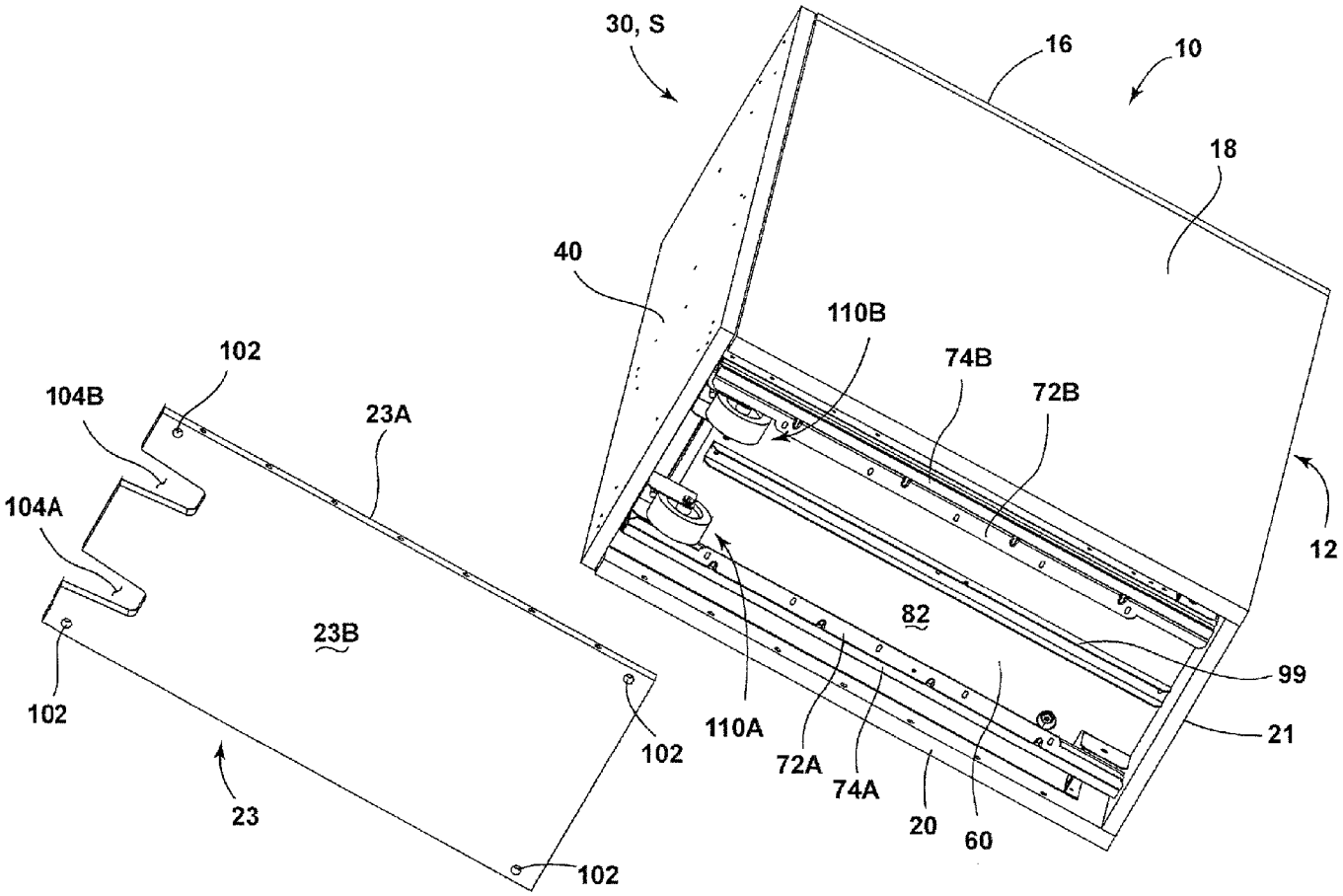
FIG. 4B is a bottom perspective view of the storage assembly of FIG. 4A, having a bottom wall exploded away therefrom.

Referring now to FIG. 4B, the bottom wall 23 is shown as a panel removed from the storage assembly 10 with relief portions 104A, 104B disposed therethrough. The rolling members 110A, 110B are shown as first and second caster assemblies 110A, 110B coupled to the base assembly 60. As noted above, the caster wheels 112A, 112B may extend through the relief portions 104A, 104B of the bottom wall 23 to support the slide out storage assembly 30 in a rolling manner on a support surface. It is further contemplated that the first and second caster assemblies 110A, 110B may be anti-tip caster assemblies.

Figure 5:
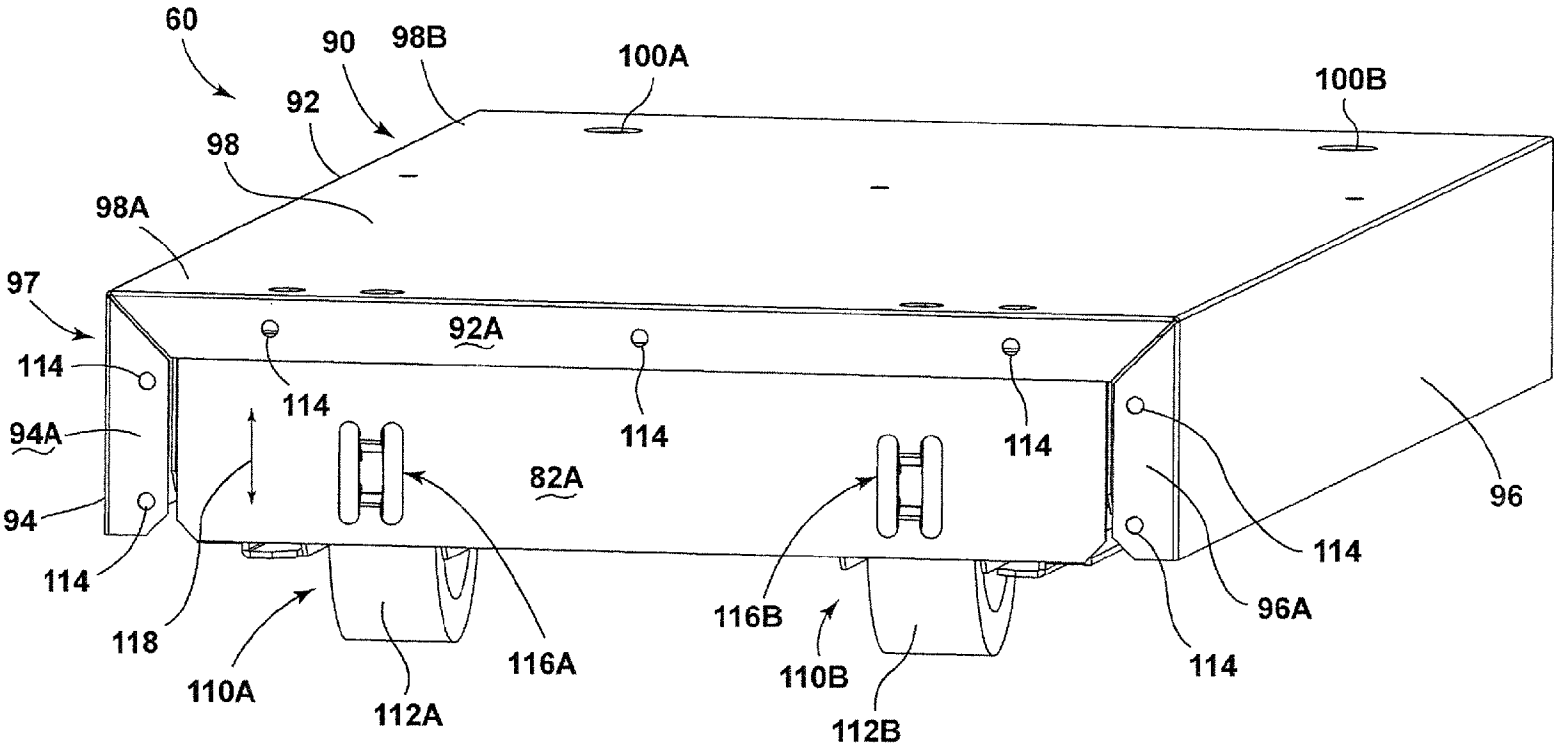
FIG. 5 is a top perspective view of a base assembly.

Referring now to FIG. 5, the base assembly 60 is shown as removed from the storage assembly 10. In FIG. 5, the base assembly 60 is shown having the outer shell 90 disposed over the chassis member 80, wherein the outer shell 90 includes a front portion 98A and a rear portion 98B of the platform 98. The rear portion 98B of platform 98 may include pivoting connecting sites 100A, 100B for coupling the outer shell 90 to the chassis member 80 in a pivoting manner. The front portion 98A of the platform 98 may include a connecting face 97 defined by folded-over portions 92A, 94A and 96A of top wall 92 and sidewalls 94, 96, respectively. Each of the folded-over portions 92A, 94A and 96A of the connecting face 97 may include mounting apertures 114 for coupling the outer shell 90 to the faceplate 40, as further described below. The chassis member 80 may include a front plate 82A having integrally formed mounting brackets 116A, 116B. In assembly, the integrally formed mounting brackets 116A, 116B may be used to couple the caster assemblies 110A, 110B to the chassis member 80. As coupled to the chassis member 80 in FIG. 5, the caster assemblies 110A, 110B may be vertically adjustable along the integrally formed mounting brackets 116A, 116B in the direction as indicated by arrow 118. Vertical adjustment of the caster assemblies 110A, 110B is further described below.

Figure 6:
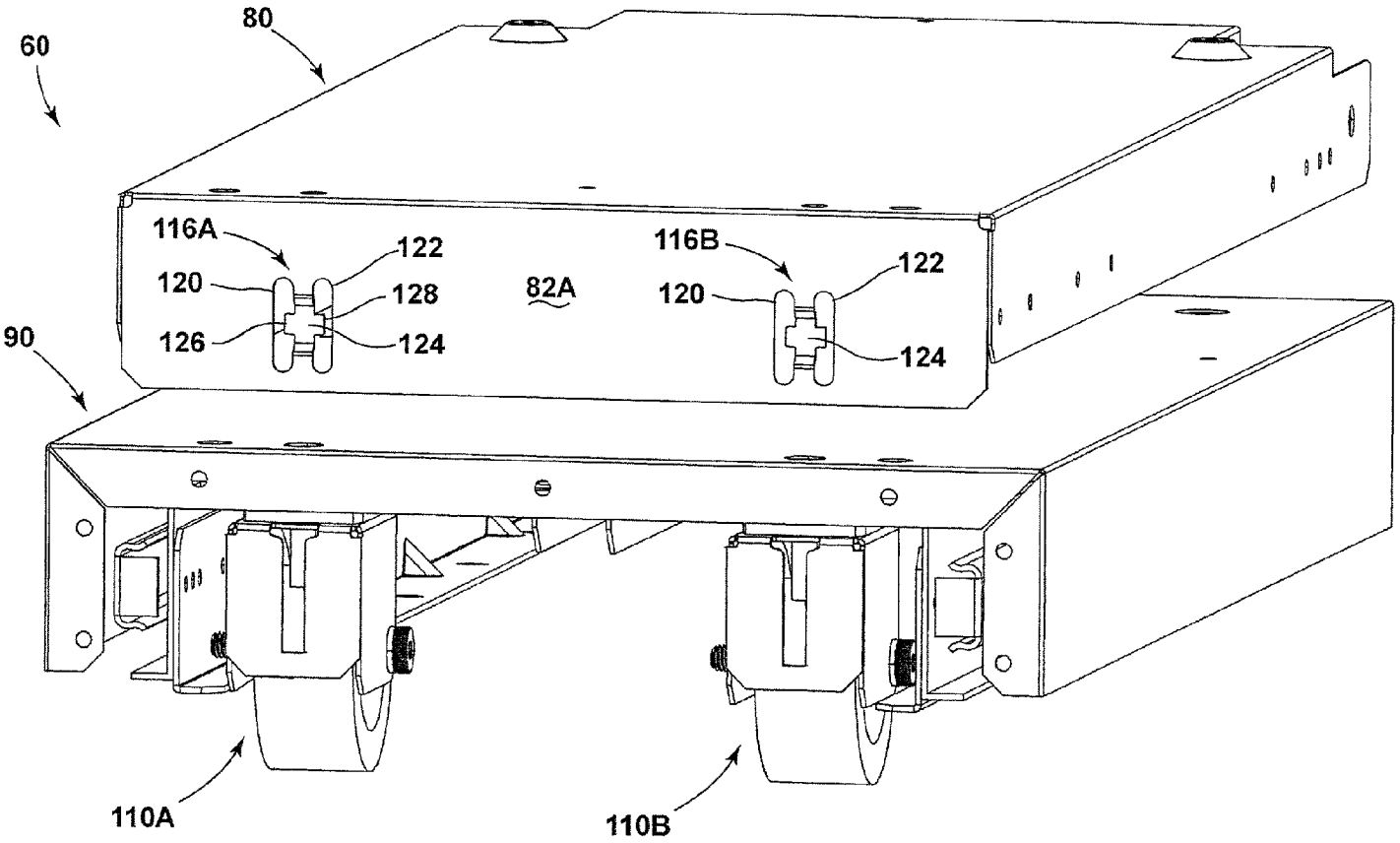
FIG. 6 is a top perspective view of the base assembly of FIG. 5, having a chassis member exploded away therefrom.

Referring now to FIG. 6, the chassis member 80 is shown exploded away from under the outer shell 90 and the integrally formed mounting brackets 116A, 116B of the chassis member 80 are revealed. The integrally formed mounting brackets 116A, 116B may be stamped brackets or punch-out brackets that are generally formed in a sheet metal stamping process to provide generally parallel vertical slots 120, 122 with an inwardly positioned cross-shaped retaining member 124 disposed between the slots 120, 122. The retaining member 124 may include outwardly extending retaining tabs 126, 128 for retaining an associated caster assembly in use. It is further contemplated that the brackets 116A, 116B may be formed on separate brackets that are mounted to an interior surface of the front plate 82A of the chassis member 80.

As further shown in FIG. 6, the caster assemblies 110A and 110B are substantially similar and will be described using the same reference numerals below. The caster assemblies 110A and 110B may include a caster housing 130 including a front wall 132, opposing sidewalls 134, 136, and a top wall 138, best shown in FIG. 7. The caster wheels 112A, 112B may be supported in each of the caster assemblies 110A and 110B by axles 140 (FIG. 8) spanning the opposing sidewalls 134, 136. The front wall 132 includes an outer surface 132A and an inner surface 132B (FIG. 8). The front wall 132 may further include a central fastening slot 142 having an open top 144 which may be partially disposed on the front wall 132 and the top wall 138 of the caster housing 130. In assembly, the retaining members 124 of the integrally formed mounting brackets 116A, 116B of the chassis member 80 may be received in the fastening slots 142 of the caster housings 130, respectively, to slideably couple the caster assemblies 110A and 110B to the base assembly 60, as shown in FIG. 5.

Figure 7:
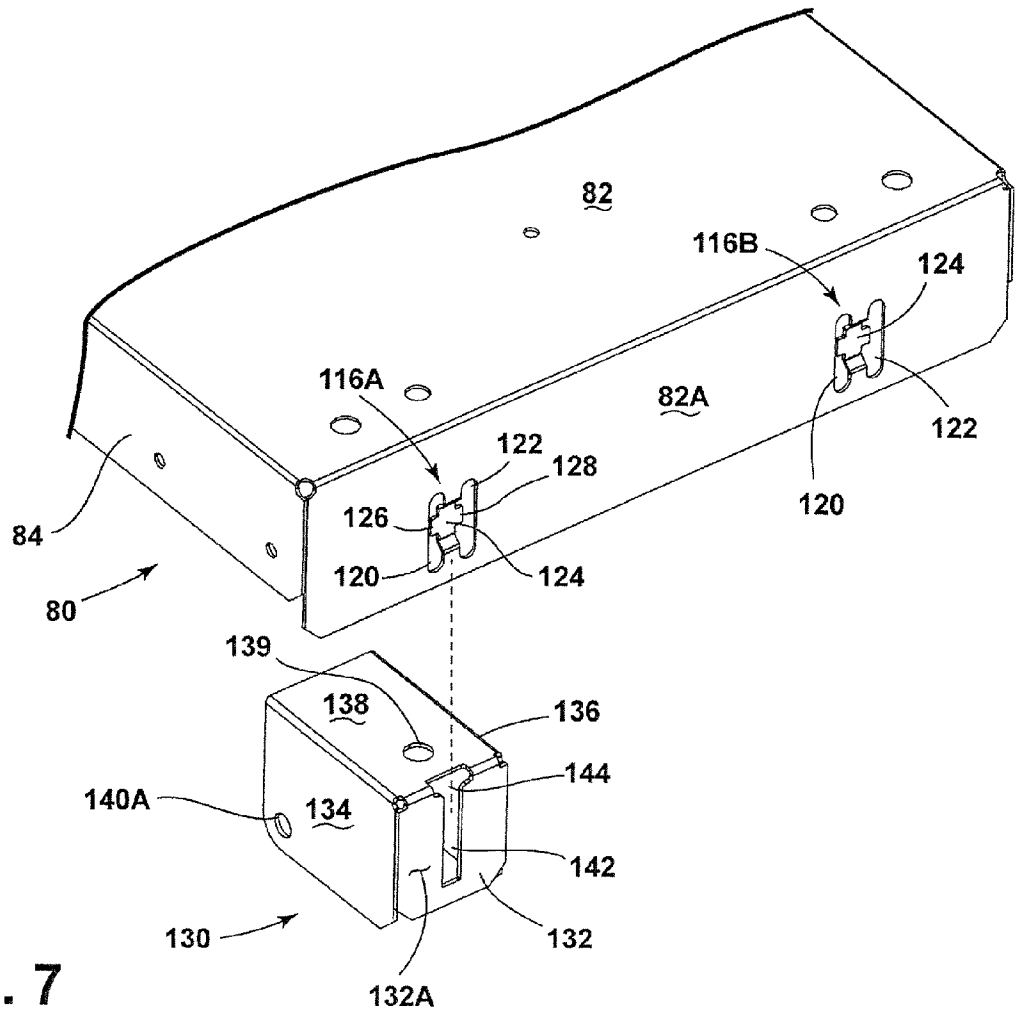
FIG. 7 is a top perspective view of a chassis member, having a caster housing exploded away therefrom.
Figure 8:
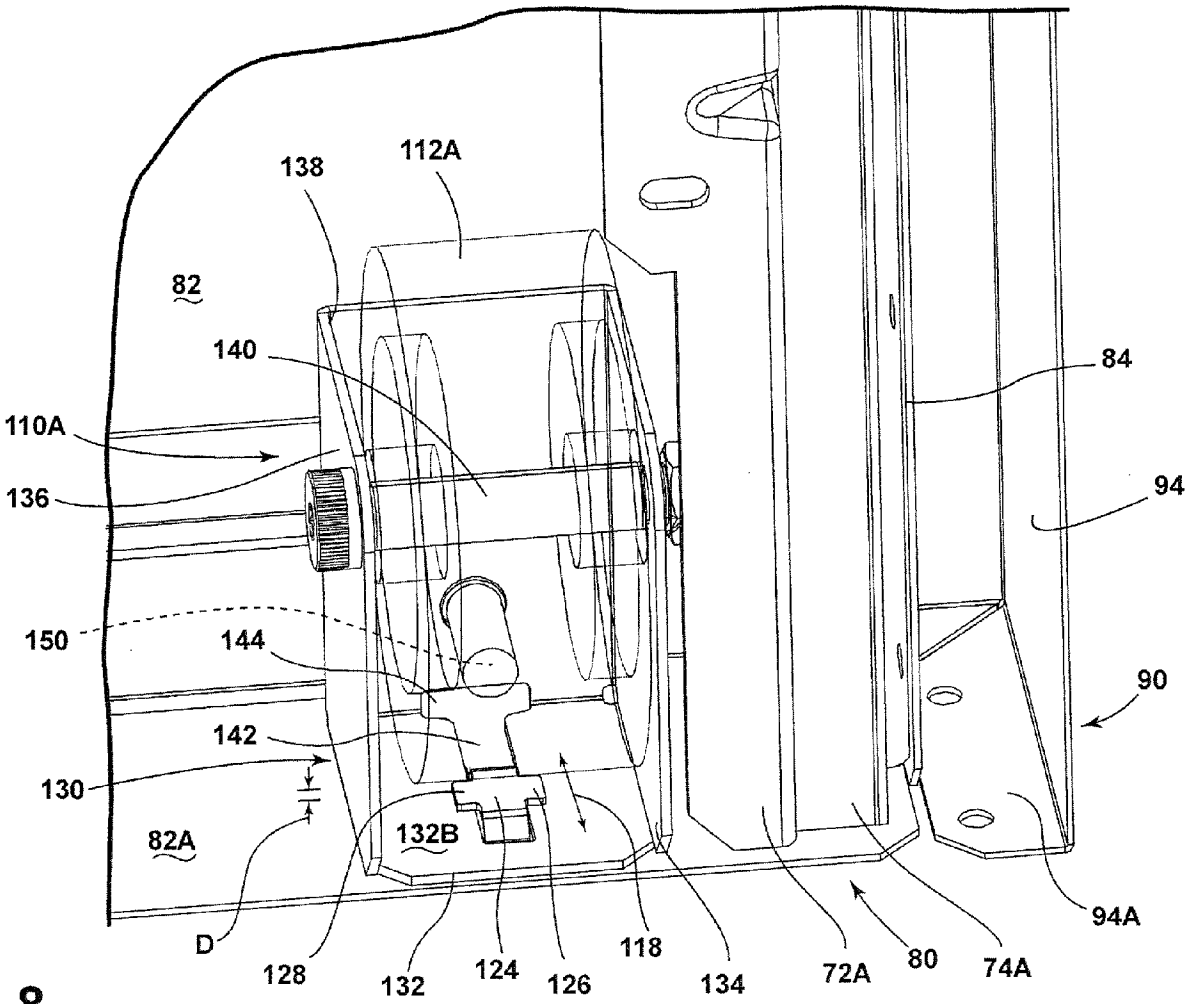
FIG. 8 is a bottom perspective view of a caster assembly coupled to a chassis member.

Referring now to FIG. 7, caster housing 130 is shown exploded away from the chassis member 80. As shown in FIG. 7, fastening slot 142 may be disposed through the front wall 132 of the caster housing 130, with the open top 144 of fastening slot 142 partially disposed on the top wall 138 and the front wall 132. As identified in FIG. 7, the retaining member 124 of integrally formed mounting bracket 116A may be configured to be received through the open top 144 of fastening slot 142 in assembly. Thus, open top 144 of fastening slot 142 may be configured to allow the outwardly extending retaining tabs 126, 128 of the retaining member 124 to slide therethrough for retaining against the inner surface 132B (FIG. 8) of the front wall 132 of the caster housing 130 at fastening slot 142. As further shown in FIG. 7, the caster housing 130 may further include a mounting aperture 139 disposed through top wall 138, and a mounting aperture 140A disposed through sidewall 134 for mounting an axle for a caster received in the caster housing 130.

Referring now to FIG. 8, the outwardly extending tabs 126, 128 may bear against the inner surface 132B of the caster housing 130 to retain the caster assembly 110A on the chassis member 80 in a first direction. While coupled to the chassis member 80, the caster assembly 110A can still move vertically along the path as indicated by arrow 118. As noted above, the cross-shaped retaining member 124 of the integrally formed mounting bracket 116A may extend inwardly from front plate 82A of chassis member 80 to a depth as indicated by arrow D. The depth D may be configured to accommodate a thickness of the front wall 132 of the caster housing 130, such that the cross-shaped retaining member 124 retains the caster assembly 110A at fastening slot 142 of the chassis member 80 in a generally friction-fit manner. Vertical adjustment of the caster assembly 110A along the front plate 82A of chassis member 80 may be carried out using an adjustment mechanism 150A, as further described below.

Figure 9:
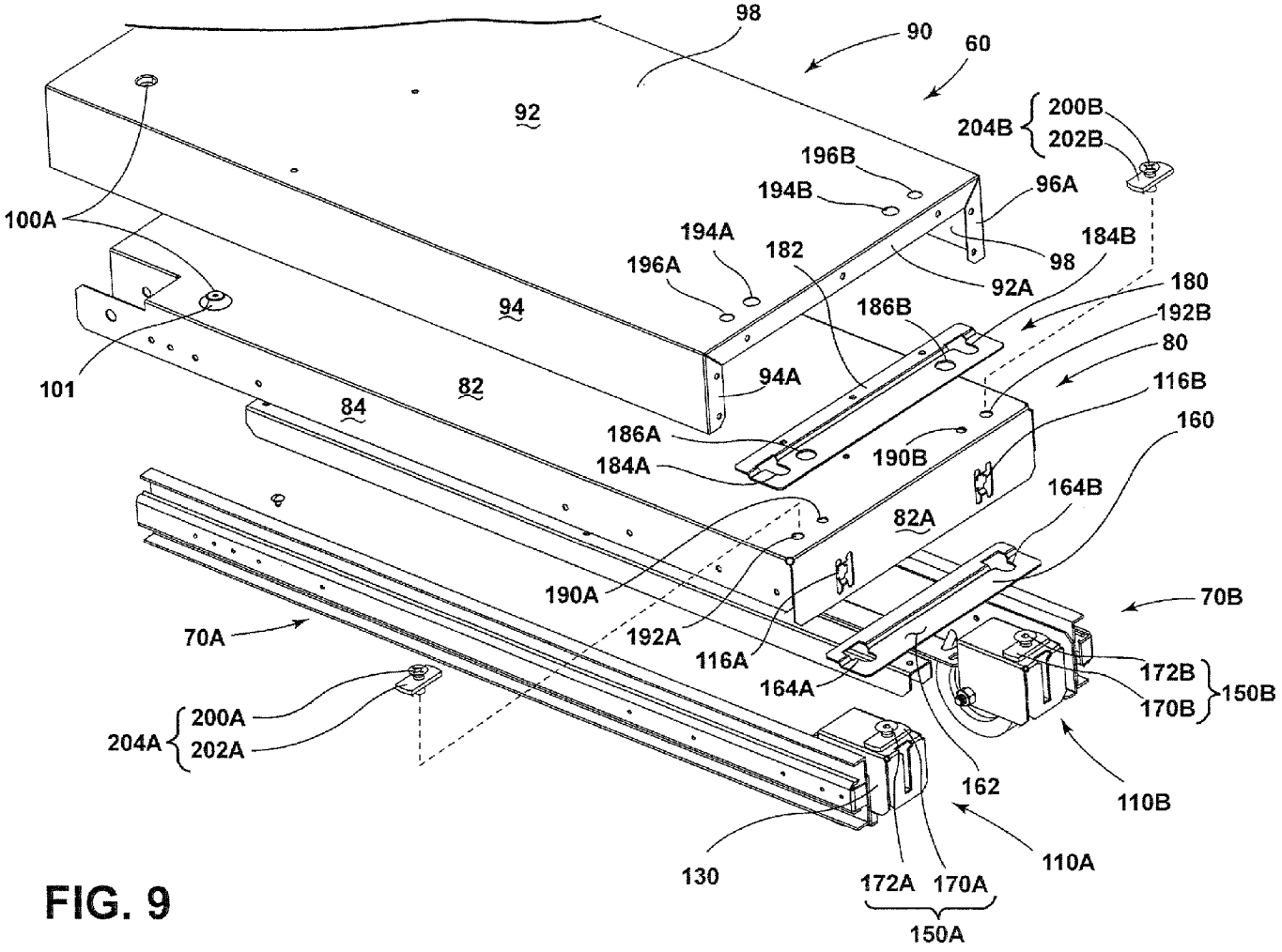
FIG. 9 is an exploded top perspective view of the base assembly of FIG. 5.

Referring now to FIG. 9, the base assembly 60 is shown in an exploded view with the outer shell 90 exploded away from the chassis member 80, which is further exploded away from the caster assemblies 110A, 110B and slide assemblies 70A, 70B. In FIG. 9, with the outer shell 90 exploded away from the chassis member 80, one or more dome-shaped coupling locations 101 may be revealed on the top wall 82 of the chassis member 80, which may facilitate pivoting of the outer shell 90 relative to the chassis member 80 at pivot locations 100A and 100B (FIG. 5). As further shown in FIG. 9, a first mounting plate 160 is shown having a stepped body portion 162 with first and second mounting slots 164A, 164B disposed therethrough. In assembly, the upper portion of the stepped body portion 162 of the mounting plate 160 may be coupled to an underside of the top wall 82 of the chassis member 80 in a fixed manner, such as by welding. As further shown in FIG. 9, each caster assembly 110A, 110B may include a threaded member 170A, 170B, such as a weld nut, mounted thereto. Fasteners 172A, 172B are contemplated to be threadingly engaged with the threaded members 170A, 170B. Each fastener 172A, 172B is further received through the respective mounting apertures 139 disposed on the top wall 138 of the caster housings 130, as best shown in FIG. 7. In assembly, and as further described below, fastener 172A may be received through mounting slot 164A of first mounting bracket 160, thereby retaining caster assembly 110A in a second direction. The caster assembly 110A may also be retained by its coupling to the front plate 82A of the chassis member 80 via fastening slot 142, as described above, in a first direction. In this way, the caster assemblies 110A, 110B may be substantially retained to the chassis member 80 from any type of lateral movement once coupled thereto. As noted above, the caster assemblies 110A, 110B may still be vertically adjustable along the front plate 82A of the chassis member 80 via the adjustment mechanisms 150A, 150B. The adjustment mechanism 150A may be defined by the fastener 172A as threadingly engaged with threaded member 170A disposed on the top wall 138 of the caster housing 130. By adjusting the fastener 172A relative to the threaded member 170A, the caster assembly 110A may move vertically even while coupled to the front plate 82A of the chassis member 80. Fastener 172B may be coupled to caster assembly 110B for adjustment thereof, in a manner similar to fastener 172A. Access to fasteners 172A, 172B is further described below.

With further reference to FIG. 9, a second mounting plate 180 may be disposed between the outer shell 90 and chassis member 80. In assembly, the second mounting plate 180 may be coupled to the underside of top wall 92 of the outer shell 90 at an upper portion of a stepped body portion 182 thereof. As fixedly coupled to the underside of the top wall 92 of the outer shell 90, the second mounting plate 180 may include first and second mounting slots 184A, 184B as well as through apertures 186A, 186B. The chassis member 80 may include abutment apertures 190A, 190B as well as through apertures 192A, 192B. In assembly, the abutment apertures 190A, 190B may align with the mounting slots 164A, 164B of the first mounting plate 160. The abutment apertures 190A, 190B may further align with the through apertures 186A, 186B of the second mounting plate 180. The through apertures 192A, 192B may be disposed outside of the stepped body portion 162 of the first mounting plate 160 and may be configured to align with the mounting slots 184A, 184B of the second mounting plate 180. As further shown in FIG. 9, the outer shell 90 may include abutment apertures 196A, 196B and access apertures 194A, 194B. The abutment apertures 196A, 196B may be configured to align with mounting slots 184A, 184B of the second mounting plate 180, in assembly. Fasteners 200A, 200B are shown in FIG. 9 as threadingly engaged with threaded members 202A, 202B, respectively. The threaded members 202A, 202B may be weld nuts that are welded to the top wall 82 of the chassis member 80 at through apertures 192A, 192B of the chassis member 80. The fasteners 200A, 200B may be accessible through abutment apertures 196A, 196B and couple to mounting slots 184A, 184B of the second mounting plate 180 in assembly. The fasteners 200A, 200B may further pass through, respective through apertures 192A, 192B of the chassis member 80 in assembly. Fasteners 172A, 172B and threaded members 170A, 170B may define adjustment mechanisms 150A, 1506, respectively, for adjusting the vertical height of the caster assemblies 110A, 110B. Fasteners 200A, 200B and threaded members 202A, 202B may define adjustment mechanisms 204A, 204B, respectively, for adjusting the outer shell 90 relative to the chassis member 80. Adjustment mechanisms 204A, 204B may further adjust the position of the faceplate 40 (FIG. 1) relative to the storage cabinet 12, as the faceplate 40 is coupled to the outer shell 90, as described above. Adjustment of the faceplate 40 is further described below.

Figure 10:
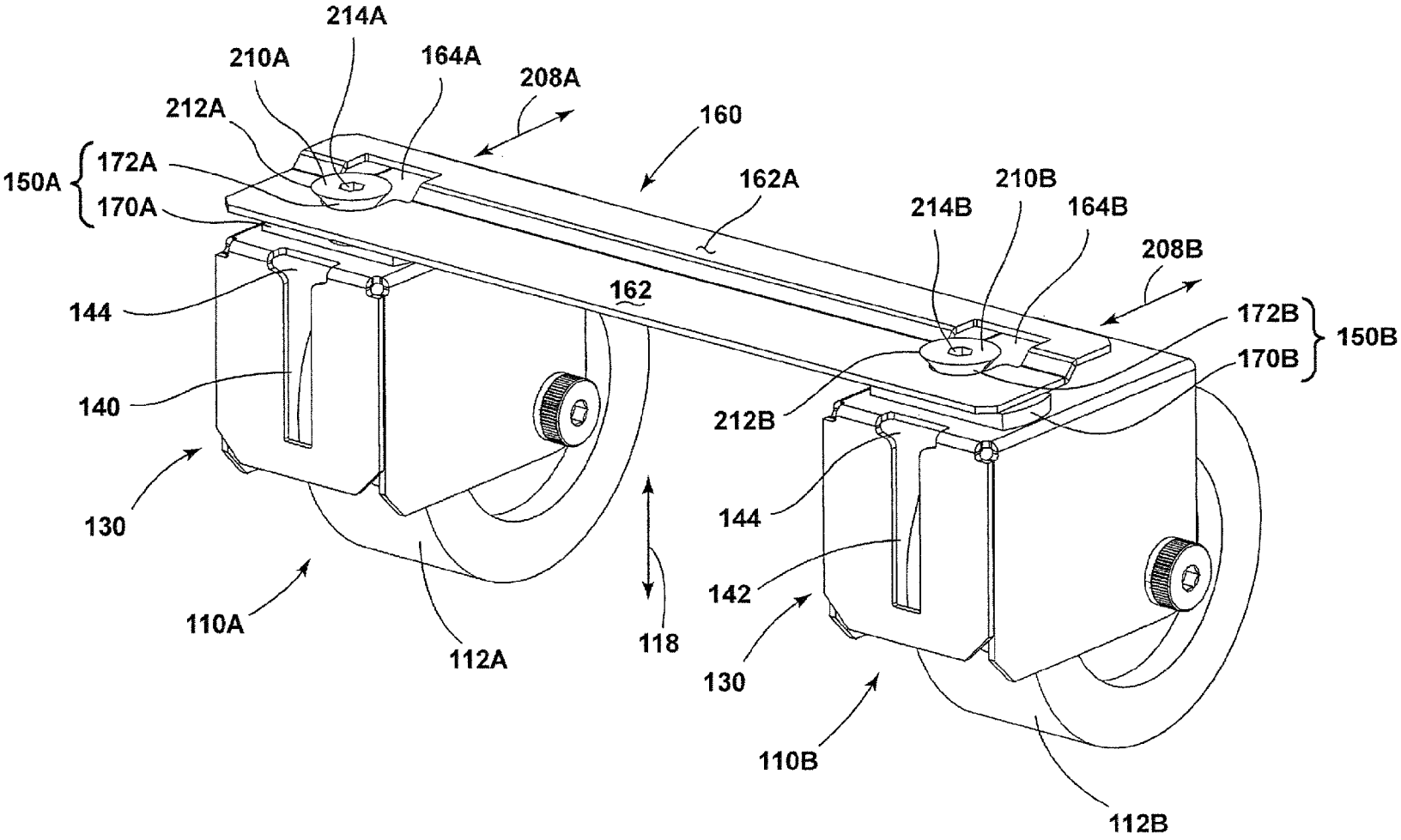
FIG. 10 is a top perspective view of first and second caster assemblies coupled to a mounting plate.
Figure 11:
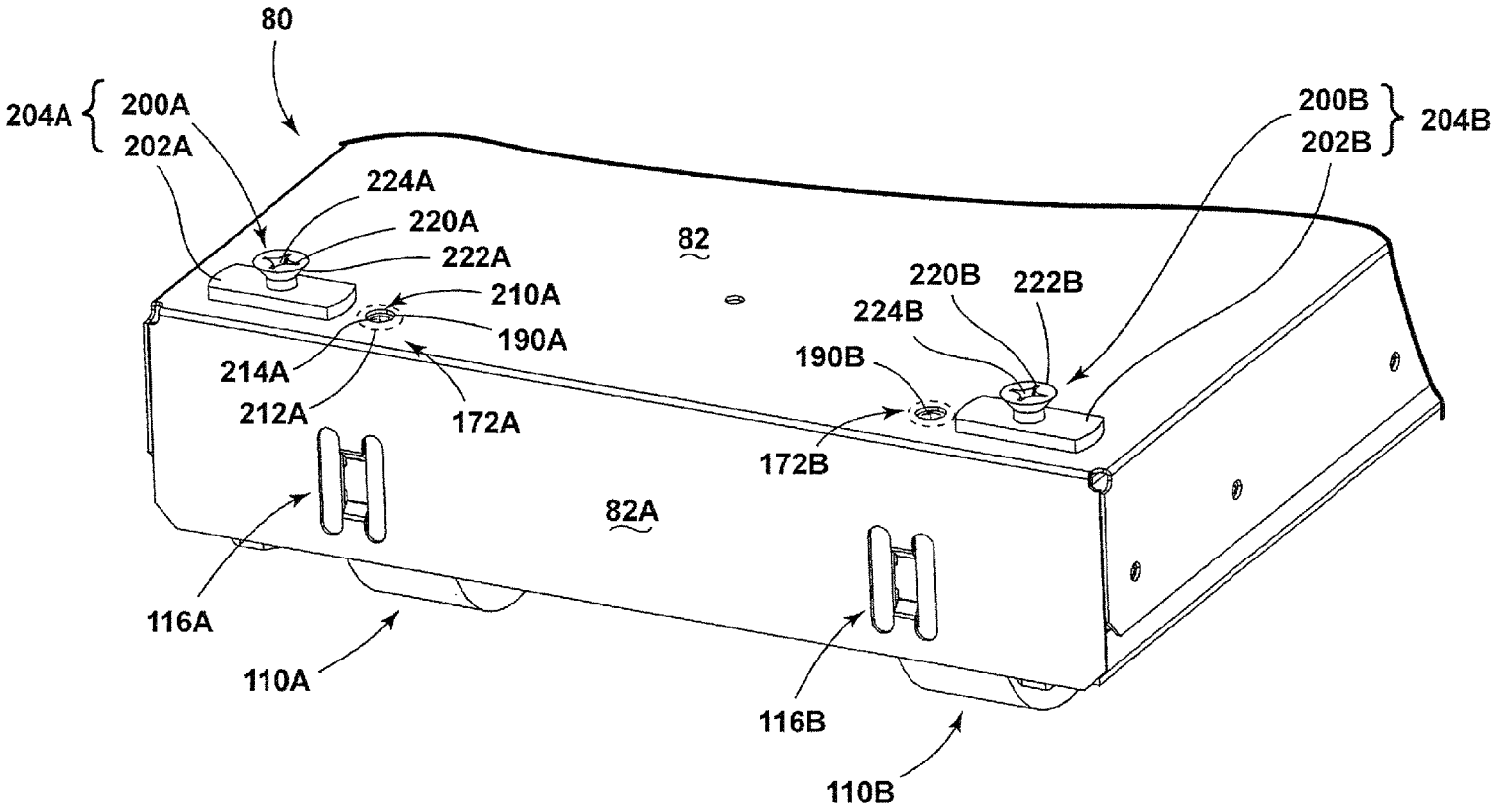
FIG. 11 is a top perspective view of a base assembly having an outer shell removed therefrom to reveal first and second adjustment mechanisms mounted to a chassis member.

Referring now to FIG. 10, caster assemblies 110A and 110B are shown coupled to the first mounting plate 160. Specifically, fastener 172A is shown received in mounting slot 164A of the first mounting plate 160, and fastener 172B is shown received in mounting slot 164B of the first mounting plate 160. Each of the fasteners 172A, 172B may threadingly engage with their respective threaded members 170A, 170B and be received in mounting slots 164A, 164B in directions indicated by arrows 208A, 208B. This sliding insertion of the fasteners may be made possible by the stepped body portion 162 of the first mounting plate 160 which includes an upper portion 162A for coupling the first mounting plate 160 to an underside of the top wall 82 of the chassis member 80. The fasteners 172A, 172B and the associated threaded members 170A, 170B may define the adjustment mechanisms 150A, 150B for the vertical positioning of the caster assemblies 110A, 110B, respectively. The fasteners 172A, 172B may each include head portions 210A, 210B which may be configured to abut the underside of top wall 82 of the chassis member 80 in assembly at abutment apertures 190A, 190B respectively. Thus, the head portions 210A, 210B of the fasteners 172A, 172B may include outer diameters 212A, 212B which are larger than the diameters of the abutment apertures 190A, 190B disposed on the chassis member 80 for an abutting configuration as best shown in FIG. 11. In the center of the head portions 210A, 2106 of the fasteners 172A, 172B, engagement features 214A, 214B may be disposed for engaging a tool used to adjust the vertical position of the caster assemblies 110A, 110B along the path as indicated by arrow 118. Once the caster assemblies 110A, 110B are properly positioned for support of the slide-out storage assembly 30 on a floor surface, the faceplate 40 (FIG. 3A) can be adjusted to ensure that the faceplate 40 is plumb and properly aligns with the opening 24 of the storage cabinet 12 as described above.

Figure 12:
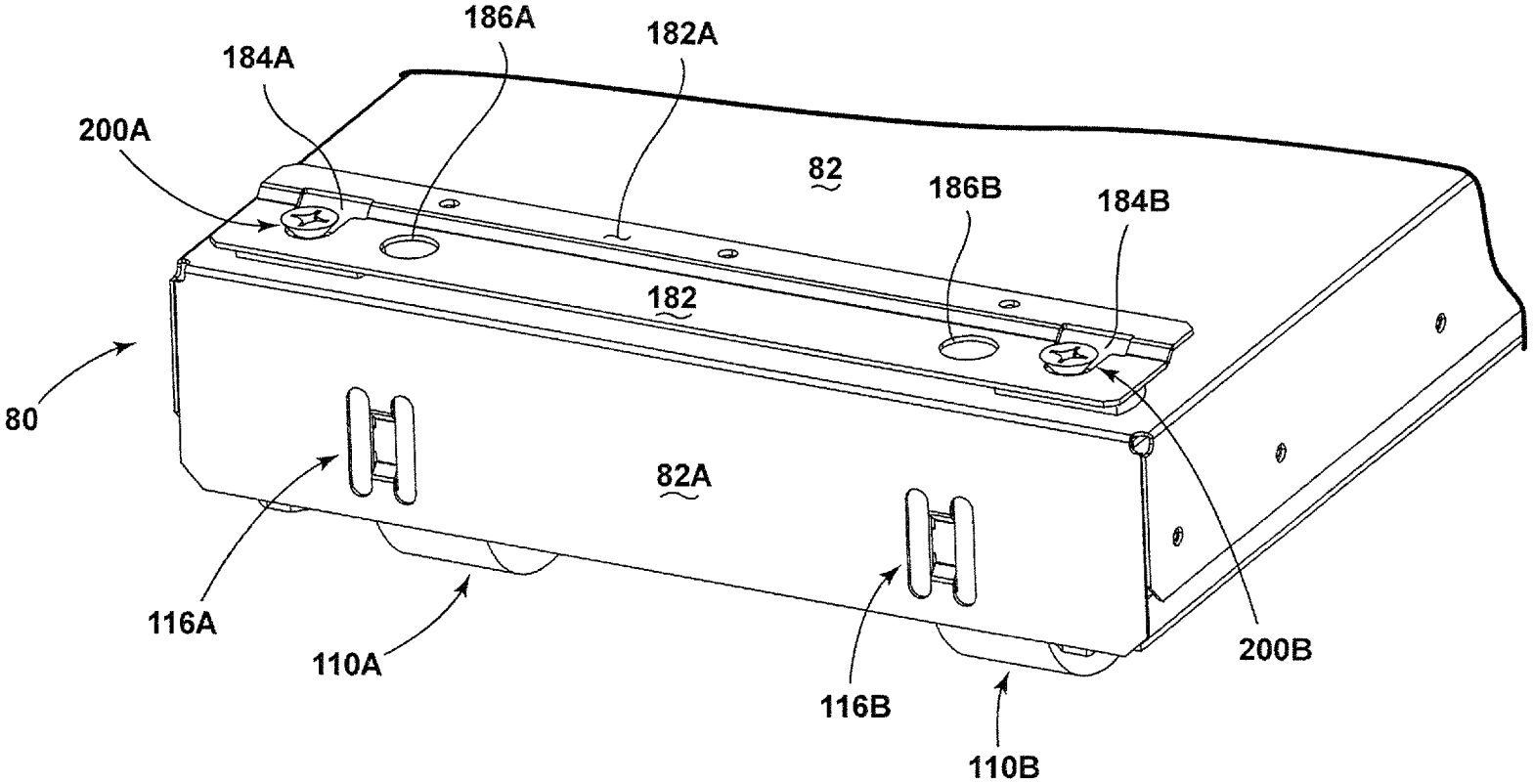
FIG. 12 is a top perspective view of a mounting plate coupled to the adjustment mechanisms of FIG. 11.
Figure 13:
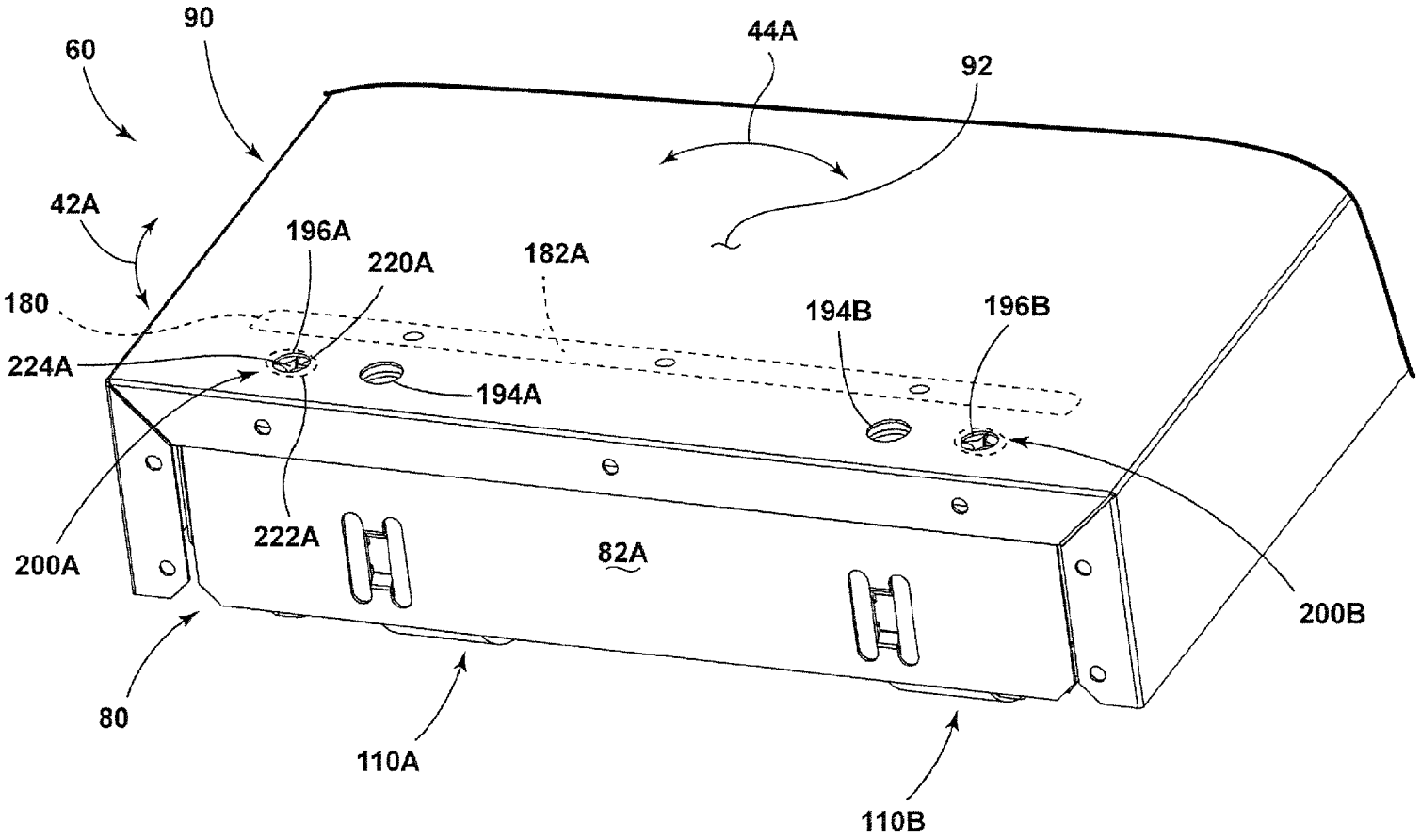
FIG. 13 is a top perspective view of the base assembly of FIG. 11 having the outer shell disposed thereon with a portion of the mounting plate of FIG. 12 shown in phantom.

Referring now to FIG. 11, threaded members 202A, 202B are shown coupled to the top wall 82 of the chassis member 80 with fasteners 200A, 200B threadingly engaged therewith, respectively, to define adjustment mechanisms 204A, 204B. Like fasteners 172A, 172B, fasteners 200A, 200B may also include head portions 220A, 220B which may be configured to abut the underside of top wall 92 of the outer shell 90 in assembly at abutment apertures 196A, 196B, respectively. Thus, the head portions 220A, 220B of the fasteners 200A, 200B may include outer diameters 222A, 222B which are larger than the diameters of the abutment apertures 196A, 196B, making for an abutting configuration as best shown in FIG. 13. In this way, the outer shell 90 may rest on the head portions 220A, 220B of the fasteners 200A, 200B for adjustment therewith. Like fasteners 172A, 172B, fasteners 200A, 200B may also include engagement features 224A, 224B on the head portions 220A, 220B for adjusting a vertical position of the fasteners 200A, 200B using an adjustment tool. With reference to FIG. 12, the fasteners 200A, 200B are shown disposed in the mounting slots 184A, 184B, respectively, of the second mounting plate 180 which, as described above, may be fixedly coupled to the underside of top wall 92 of outer shell 90 at an upper portion 182A of the stepped body portion 182 of the second mounting plate 180.

Referring now to FIG. 13, the outer shell 90 is shown disposed over chassis member 80, and the abutting arrangement between the fasteners 200A, 200B and the outer shell 90 can be seen at abutment apertures 196A, 196B of the outer shell 90. As noted above, the fasteners 200A, 200B may be components of adjustment mechanisms 204A, 204B for adjusting the position of the platform 98 of the outer shell 90, which may be defined by the top wall 92 of the outer shell 90. Adjusting one of the adjustment mechanisms 204A, 204B may result in a tilt adjustment of the outer shell 90 in a direction as indicated by arrow 44A. When the adjustment mechanisms 204A, 204B are adjusted in concert, the outer shell 90 may pivot along a path as indicated by arrow 42A at pivot locations 100A and 100B (FIG. 5). The tilt and pivoting adjustments of the outer shell 90 may coincide with the adjustment of the faceplate 40 along the path as indicated by arrows 42 and 44, as best shown in FIG. 3A. Raising the front portion of the outer shell 90 along the path indicated by arrow 42A using adjustment mechanisms 204A, 204B, may result in the upper portion 40A (FIG. 3A) of the faceplate 40 moving inwardly towards to the storage cabinet 12 long path 42 (FIG. 3A). Lowering the front portion of the outer shell 90 along the path indicated by arrow 42A via the adjustment mechanisms 204A, 204B, may result in the upper portion 40A of the faceplate 40 moving outwardly away from to the storage cabinet 12 along path 42 (FIG. 3A). In this way, the adjustment mechanisms 204A, 204B may be configured to adjust the fore and aft position of the upper portion 40A of the faceplate 40. As further shown in FIG. 13, access apertures 194A, 194B in the outer shell 90 may provide access to fasteners 172A, 172B (FIG. 10) for adjusting the vertical position of the caster assemblies 110A, 110B, respectively.

Figure 14:
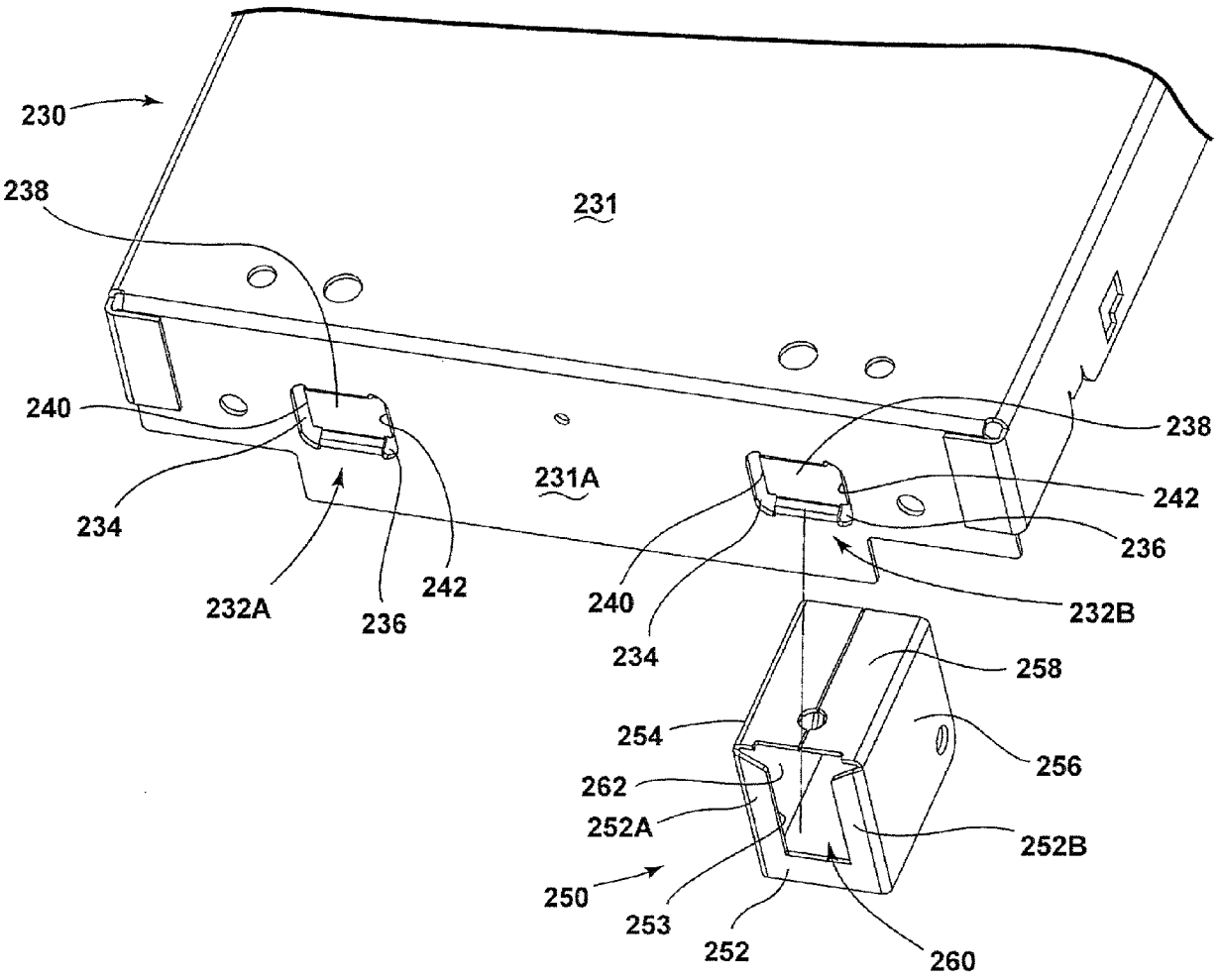
FIG. 14 is a top perspective view of a chassis member according to another embodiment, having a caster housing of another embodiment exploded away therefrom.

Referring now to FIG. 14, another embodiment of a chassis member 230 is shown having integrally formed mounting brackets 232A, 232B which may resemble mounting brackets 116A, 116B, shown and described above, with reference to FIG. 6. In the embodiment shown in FIG. 14, the integrally formed mounting brackets 232A, 232B may be stamped brackets or punch-out brackets that are generally formed from a sheet metal material via a stamping process to provide substantially parallel vertical slots 234, 236 disposed along a front plate 231A of the chassis member 230. Similar to the embodiments described above, the chassis member 230 includes a top plate 231 having a downwardly extending front plate 231A. The front plate 231A may be used to couple one or more caster assemblies thereto using the integrally formed first and second mounting brackets 232A, 232B. The integrally formed mounting brackets 232A, 232B may include inwardly positioned cross-shaped retaining members 238 which may further include outwardly extending retaining tabs 240, 242 for retaining an associated caster assembly in use.

Figure 15:
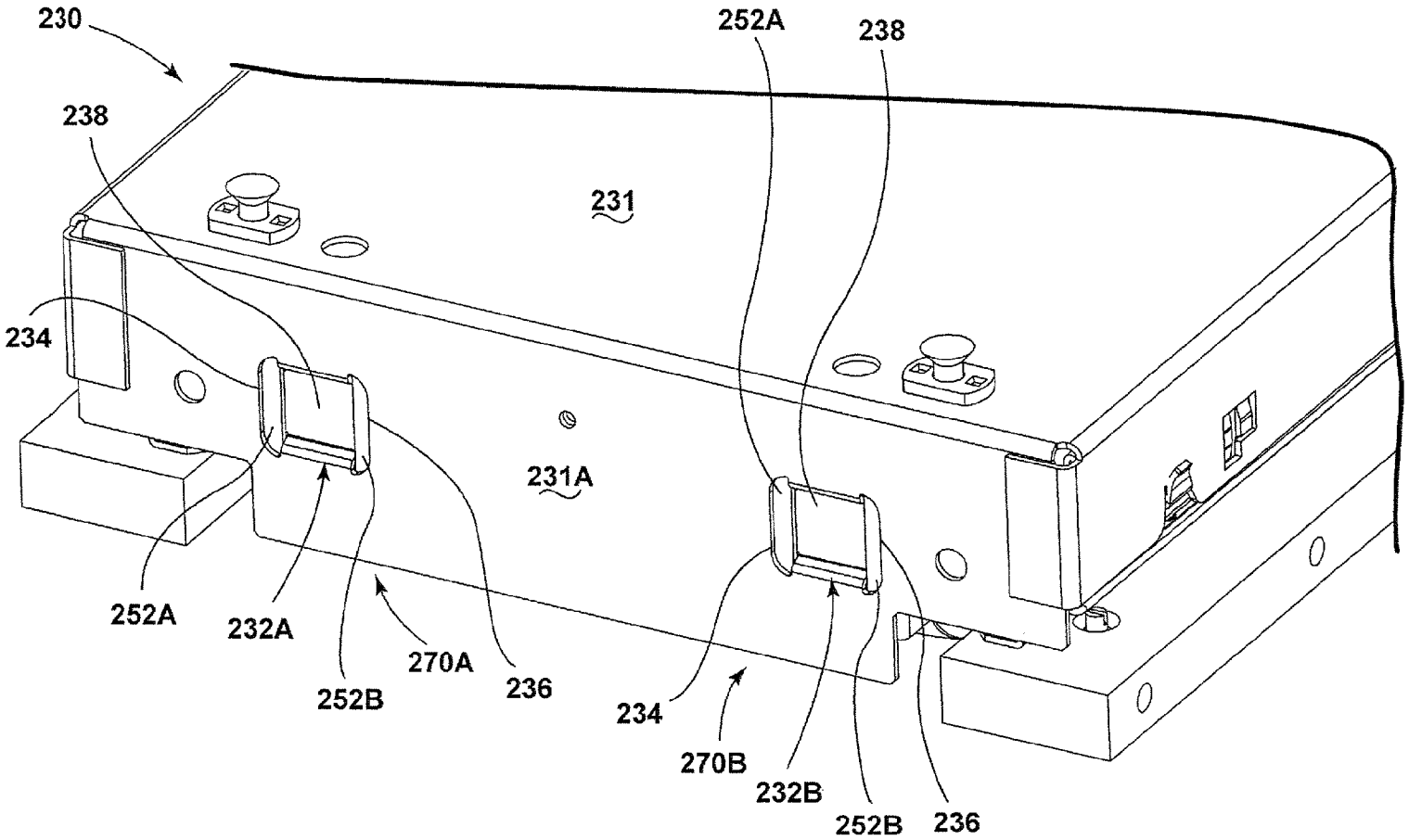
FIG. 15 is a top perspective view of the chassis member of FIG. 14 having first and second caster assemblies coupled thereto.

As further shown in FIG. 14, another embodiment of a caster housing 250 is shown, wherein the caster housing 250 may include a front wall 252, opposing side walls 254, 256 and a top wall 258. In this way, the caster housing 250 may include a substantially square-shaped configuration similar to caster housings 130 described above. The front wall 252 may further include a central fastening slot 260 having an open top portion 262 which is partially disposed on the front wall 252 and partially disposed on the top wall 258. The central fastening slot 260 may generally be defined by first and second portions 252A, 252B of front wall 252 of the caster housing 250. In assembly, the cross-shaped retaining member 238 of the chassis member 230 may be received within the open top portion 262 of the fastening slot 260 to retain the caster housing 250 on the front wall 231A of the chassis member 230. It is further contemplated that the caster housing 250 may be vertically adjustable with respect to the chassis member 230 using an adjustment system similar to that described above with reference to caster housing 130. When the caster housing 250 is coupled to either of the integrally formed mounting brackets 232A, 232B, the outwardly extending retaining tabs 240, 242 of the integrally formed mounting brackets 232A, 232B are contemplated to bear against an inner surface 253 of the front wall 252 of the caster housing 250. With reference to FIG. 15, first and second caster assemblies 270A, 270B are contemplated to be coupled to the front wall 231A of chassis member 230. This coupling between the first and second caster assemblies 270A, 270B is demonstrated in FIG. 15 by the cross-shaped retaining members 238 shown coupled to first and second portions 252A, 252B of the front wall 252 of the caster housing 250 appearing through slots 234, 236 of the integrally formed mounting brackets 232A, 232B.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A storage unit, comprising:

a first storage assembly having a housing defining an interior space; and a second storage assembly operable between stowed and extended positions relative to the interior space of the first storage assembly, the second storage assembly having a base assembly with a faceplate adjustably coupled thereto, wherein the faceplate closes off an opening to the interior space of the first storage assembly when the second storage assembly is in the stowed position, wherein the base assembly of the second storage assembly includes a chassis member having an outer shell disposed thereon, wherein the chassis member includes a top wall having downwardly extending sidewalls, and the outer shell includes a top wall and downwardly extending sidewalls, wherein the outer shell is adjustable relative to the chassis member.

2. The storage unit of claim 1, wherein the faceplate includes a lower portion coupled to the outer shell of the base assembly of the second storage assembly.

3. The storage unit of claim 2, including:

one or more adjustment mechanisms disposed in the base assembly for adjusting an angle of the outer shell.

4. The storage unit of claim 3, wherein each of the one or more adjustment mechanisms includes:

a threaded member coupled to the chassis member; and a fastener adjustably received in the threaded member, wherein the fastener includes a head portion having an outer diameter and an engagement feature.

5. The storage unit of claim 4, wherein the outer shell includes one or more abutment apertures disposed therethrough, wherein each of the one or more abutment apertures is configured to align with an associated adjustment mechanism of the one or more adjustment mechanisms.

6. The storage unit of claim 5, wherein the outer shell is abuttingly supported on one or more of the head portions of the fasteners disposed in the one or more adjustment mechanisms.

7. The storage unit of claim 6, wherein the outer diameter of the head portion of each fastener abuts the outer shell, and further wherein the engagement feature of the each head portion of each fastener is accessible through the one or more abutment apertures disposed through the outer shell for adjusting a vertical position of the fastener.

8. The storage unit of claim 3, wherein vertical adjustment of the one or more adjustment mechanisms imparts a fore and aft adjustment to an upper portion of the faceplate.

9. The storage unit of claim 3, wherein vertical adjustment of one of the one or more adjustment mechanisms imparts a tilt adjustment of the faceplate.

10. The storage unit of claim 1, wherein the second storage assembly is coupled to the first storage assembly by one or more slide assemblies coupled between the base assembly of the second storage assembly and the housing of the first storage assembly.

11. A storage assembly, comprising:

a storage cabinet having an interior space;

a slide-out storage assembly operable between stowed and extended positions relative to the interior space of the storage cabinet, wherein the slide-out storage assembly includes a base assembly having one or more adjustable caster assemblies coupled thereto, the one or more adjustable caster assemblies configured to support the base assembly from a floor surface;

a mounting plate coupled to an underside of the base assembly of the slide-out storage assembly; and one or more adjustment mechanisms coupled to the mounting plate on a first end and further coupled to a caster housing of an associated caster assembly on an opposite second end, wherein the one or more adjustment mechanisms are configured to adjust a vertical position of the one or more adjustable caster assemblies.

12. The storage assembly of claim 11, wherein the base assembly of the slide-out storage assembly includes a chassis member having an outer shell disposed thereon, the outer shell including a top wall having one or more access apertures disposed therethrough, and further wherein the one or more access apertures are configured to align with and allow access to the one or more adjustment mechanisms for adjustment thereof.

13. The storage assembly of claim 12, wherein each of the one or more adjustment mechanisms includes:

a fastener received in a mounting slot disposed through the mounting plate; and a threaded member operably coupled to the caster housing of an associated adjustable caster assembly, wherein the threaded member is configured to threadingly receive the fastener in a vertically adjustable manner.

14. A storage assembly, comprising:

a storage cabinet having an interior space;

a slide-out storage assembly operable between stowed and extended positions relative to the storage cabinet, wherein the slide-out storage assembly includes a base assembly having one or more integrally formed mounting brackets formed thereon; and one or more caster assemblies mounted on the one or more integrally formed mounting brackets of the base assembly of the slide-out storage assembly, wherein the one or more caster assemblies are vertically adjustable along the one or more integrally formed mounting brackets.

15. The storage assembly of claim 14, wherein each of the one or more caster assemblies includes a caster housing having a fastening slot formed therein.

16. The storage assembly of claim 15, wherein each of the one or more integrally formed mounting brackets includes a retaining member configured to be slideably received in the fastening slot of the caster housing of an associated caster assembly.

17. The storage assembly of claim 16, wherein the retaining members include outwardly extending tabs configured to bear against an inner surface of the caster housing.

18. The storage assembly of claim 17, wherein the base assembly of the slide-out storage assembly includes a chassis member having an outer shell disposed thereon, the outer shell including a top wall having one or more access apertures disposed therethrough, and further wherein the one or more access apertures are configured to align with and allow access to one or more adjustment mechanisms for adjusting a vertical position of the one or more caster assemblies.

* * * * *